US005753396A

United States Patent [19]

Nakamura et al.

[11] Patent Number: 5,753,396

[45] Date of Patent: May 19, 1998

[54] IMAGE FORMING METHOD

[75] Inventors: Tatsuya Nakamura, Tokyo; Masayoshi Kato, Iruma; Shuichi Aita; Koji Inaba, both of Yokohama; Kengo Hayase, Tokyo; Yuki Nishio, Kawasaki, all of Japan

[73] Assignee: Canon Kabushiki Kaisha, Tokyo, Japan

[21] Appl. No.: 563,603

[22] Filed: Nov. 28, 1995

[30] Foreign Application Priority Data

| | | | |
|---|---|---|---|
| Nov. 28, 1994 | [JP] | Japan | 6-316072 |
| Mar. 3, 1995 | [JP] | Japan | 7-068878 |

[51] Int. Cl.[6] ..... G03G 13/06

[52] U.S. Cl. ..... 430/101; 430/100; 430/111

[58] Field of Search ..... 430/101, 111, 430/100

[56] References Cited

U.S. PATENT DOCUMENTS

| | | | |
|---|---|---|---|
| 4,971,879 | 11/1990 | Kimura et al. | 430/106.6 |
| 5,219,697 | 6/1993 | Mori et al. | 430/110 |
| 5,270,143 | 12/1993 | Tomiyama et al. | 430/109 |
| 5,354,640 | 10/1994 | Kanbayashi et al. | 430/110 |
| 5,518,848 | 5/1996 | Ito et al. | 430/96 |

FOREIGN PATENT DOCUMENTS

| | | | |
|---|---|---|---|
| 0575159 | 12/1993 | European Pat. Off. . | |
| 0587067 | 3/1994 | European Pat. Off. . | |
| 0619527 | 10/1994 | European Pat. Off. . | |
| 0632337 | 1/1995 | European Pat. Off. . | |
| 0658816 | 6/1995 | European Pat. Off. . | |
| 0660199 | 6/1995 | European Pat. Off. . | |
| 0677794 | 10/1995 | European Pat. Off. . | |
| 36-10231 | 7/1961 | Japan . | |
| 56-13945 | 4/1981 | Japan | G03G 9/08 |
| 59-53856 | 3/1984 | Japan | G03G 9/08 |
| 59-61842 | 4/1984 | Japan | G03G 9/08 |

(List continued on next page.)

OTHER PUBLICATIONS

Patent Abstracts of Japan, vol. 10, No. 140 (P–458) May 23, 1986.

Patent Abstracts of Japan, vol. 17, No. 588 (P–1634) Jul., 1993.

Patent Abstracts of Japan, vol. 11, No. 142 (p–573) May, 1987.

Lee et al., "The Glass Transition Temperature of Polymers", Polymer Handbook, 2nd Ed., Brandrup, et al., publ. by J. Wiley & Sons p. III–140 to III–192.

*Primary Examiner*—Mark Chapman

*Attorney, Agent, or Firm*—Fitzpatrick, Cella, Harper & Scinto

[57] ABSTRACT

An image forming method comprising;

a charging step of electrostatically charging a photosensitive member;

an exposure step of exposing the charged photosensitive member to form an electrostatic latent image;

a developing step of bringing a toner carried on a developer carrying member, into contact with the surface of the photosensitive member to develop the electrostatic latent image to form a toner image on the photosensitive member;

a transfer step of transferring the toner image formed on the photosensitive member, to a transfer medium; and a cleaning-at-development step of collecting the toner remaining on the photosensitive member after the transfer step, onto the developer carrying member;

a wherein;

the surface of said photosensitive member has a contact angle with water of 85° or greater;

said toner contains residual monomers in an amount not more than 1,000 ppm; and said toner has a shape factor SF-1 of from 100 to 180 and a shape factor SF-2 of from 100 to 140.

24 Claims, 8 Drawing Sheets

U.S. PATENT DOCUMENTS

| | | | |
|---|---|---|---|
| 64-20857 | 1/1989 | Japan | A61M 1/02 |
| 2-51168 | 2/1990 | Japan | G03G 13/08 |
| 2-259784 | 10/1990 | Japan | G03G 15/08 |
| 4-50886 | 2/1992 | Japan | G03G 15/24 |
| 4-296766 | 10/1992 | Japan | G03G 9/08 |
| 5-19662 | 1/1993 | Japan | G03G 15/22 |
| 5-61383 | 3/1993 | Japan | G03G 21/00 |
| 5-165378 | 7/1993 | Japan | G03G 21/00 |
| 5-188637 | 7/1993 | Japan | G03G 9/087 |
| 5-69427 | 10/1993 | Japan | G03G 15/22 |

IMAGE FORMING METHOD

BACKGROUND OF THE INVENTION

1. Field of the Invention

This invention relates to an image forming method applied to printers, copying machines, facsimile machines and so forth. More particularly, it relates to an image forming method in which the same means carries out the development of electrostatic latent images and the collection of toner remaining after transfer.

2. Related Background Art

A number of methods are conventionally known for electrophotography. Generally, copies or prints are obtained by forming an electrostatic latent image on a photosensitive member by utilizing a photoconductive material and by various means, subsequently developing the latent image with a toner to form a toner image, transferring the toner image to a transfer medium such as paper if necessary, and thereafter fixing the toner image to the transfer medium with heat, pressure or heat-and-pressure. Toner particles that have not transferred to the transfer medium and remain on the photosensitive member are removed from the photosensitive member in the cleaning step.

In the cleaning step of the photosensitive member, there have been conventionally used blade cleaning, fur brush cleaning, roller cleaning and so forth. Such means mechanically scrapes off or blocks up the toner remaining after transfer (herein often "residual toner") to collect it in the waste toner container. Hence, problems due to the pressure contact of a member that constitutes such means with the photosensitive member, often arises. For example, when the cleaning member is brought in contact under strong pressure, the surface of the photosensitive member wears.

Moreover, the presence of the cleaning means necessarily makes the whole apparatus large, thus becoming a bottleneck in downsizing.

From the viewpoint of ecology, a system that produces no waste toner has been long-desired.

For example, Japanese Patent Publication No. 5-69427 discloses an image forming apparatus employing a technique called "cleaning simultaneous with development or "cleanerless" system. In such an image forming apparatus, one image is formed in one rotation of the photosensitive member so that no effect of residual toner appears in the same image. Japanese Patent Applications Laid-open No. 64-20587, No. 2-259784, No. 4-50886 and No. 5-165378 disclose a method in which the residual toner is applied to the surface of the photosensitive member by an applying member to randomize it and make it invisible when the surface of the same photosensitive member is used plural times for one image. However, voltage application is required for making the residual toner patternless, and it is difficult to make the whole apparatus compact in spite of the cleanerless system.

Japanese Patent Application Laid-open No. 2-51168 discloses a cleanerless electrophotographic printing method in which spherical toner particles and spherical carrier particles are used so that stable charging performance can be achieved. According to this method, the initial performance is satisfactory but lowering of image quality during repeated use occurs, so that running performance is required.

In the cleaning-at-development method, filming tends to occur on the photosensitive member as a result of repeated use. Japanese Patent Application Laid-open No. 5-61383 discloses making the photosensitive member surface uniform by means of a uniforming member to prevent filming, but there is still room for further improvement.

The contact charging method where a charging member is brought into contact with the photosensitive member, and the contact transfer method where a transfer member is brought into contact with the photosensitive member interposing a transfer medium usually generates little ozone and is preferable from the viewpoint of ecology. Since the transfer member also transports the transfer medium, the system has the advantage that downsizing is easy. If, however, the cleaning is not sufficient in the developing step, the charging member and the transfer member are easily soiled causing image stain, back stain of transfer medium, or transfer hollow in the middle portions of line images, which are caused by poor charging of the photosensitive member.

Japanese Patent Application Laid-open No. 5-19662 discloses the use of secondary particles obtained by fusing primary polymerized particles in a toner; Japanese Patent Application Laid-open No. 4-296766 discloses use of a polymerized toner that transmits the exposure light; and Japanese Patent Application Laid-open No. 5-188637 discloses use of a toner specified in its volume average particle diameter, number average particle diameter, charge quantity of toner, projected-image area ratio of toner and BET specific surface area of toner, where also a superior image forming method employing the cleaning-at-development system is waited for.

When the cleaning-at-development or cleanerless system is used, the toner remaining after transfer may intercept the exposure light to disturb the formation of electrostatic latent image, may prevent the desired potential to be obtained, often causing negative memory on images. In addition, if a large amount of the toner remains after transfer, it can not be completely collected in the developing step causing positive memory on images. Even if the applying member is used, the image quality often deteriorates.

Moreover, it is required to transfer the images onto various transfer media nowadays, but the cleaning-at-development or cleanerless image forming method cannot achieve satisfactory performance when transfer mediums of various types (e.g., cardboard, and overhead projector transparent film) are used.

Meanwhile, toners containing residual monomers to a certain extent easily adhere to the surface of the photosensitive member, and when contact charging methods, contact developing methods or contact transfer methods are used, more toner tends to adhere to the photosensitive member surface, making it difficult to collect the residual toner by the cleaning-at-development.

SUMMARY OF THE INVENTION

An object of the present invention is to provide an image forming method having the step of cleaning-at-development, that has solved the problems discussed above.

Another object of the present invention is to provide an image forming method that may cause less positive memory or negative memory.

Still another object of the present invention is to provide an image forming method excellent in running performance.

A further object of the present invention is to provide an image forming method that may hardly cause filming on the surface of the photosensitive member.

A still further object of the present invention is to provide an image forming method that enables a system design having an excellent transferability to various transfer mediums (e.g., cardboard, and overhead projector transparent film).

A still further object of the present invention is to provide an image forming method that can achieve smaller toner consumption than conventional methods.

A still further object of the present invention is to provide an image forming method that can give high image density and a sharp image even with a minute-dot latent image.

A still further object of the present invention is to provide an image forming method that can prevent toner deterioration where the toner on a developer carrying member comes into contact with the photosensitive member when an electrostatic latent image formed on the photosensitive member is developed.

A still further object of the present invention is to provide an image forming method that can prevent surface deterioration of the developer carrying member.

A still further object of the present invention is to provide an image forming method that enables high speed developing.

A still further object of the present invention is to provide an image forming method that may hardly cause deterioration of the photosensitive member.

The present invention provides an image forming method comprising;

a charging step of electrostatically charging a photosensitive member;

an exposure step of exposing the charged photosensitive member to form an electrostatic latent image;

a developing step of bringing a toner held on a developer carrying member, into contact with the surface of the photosensitive member to develop the electrostatic latent image to form a toner image on the photosensitive member;

a transfer step of transferring the toner image formed on the photosensitive member, to a transfer medium; and a cleaning-at-development step of collecting the toner remaining on the photosensitive member after the transfer step, onto the developer carrying member;

wherein;

the surface of the photosensitive member has a contact angle with water of 85° or greater;

the toner contains residual monomers in an amount not more than 1,000 ppm; and the toner has a shape factor SF-1 of from 100 to 180 and a shape factor SF-2 of from 100 to 140.

DESCRIPTION OF THE PREFERRED EMBODIMENTS

Figure 1:
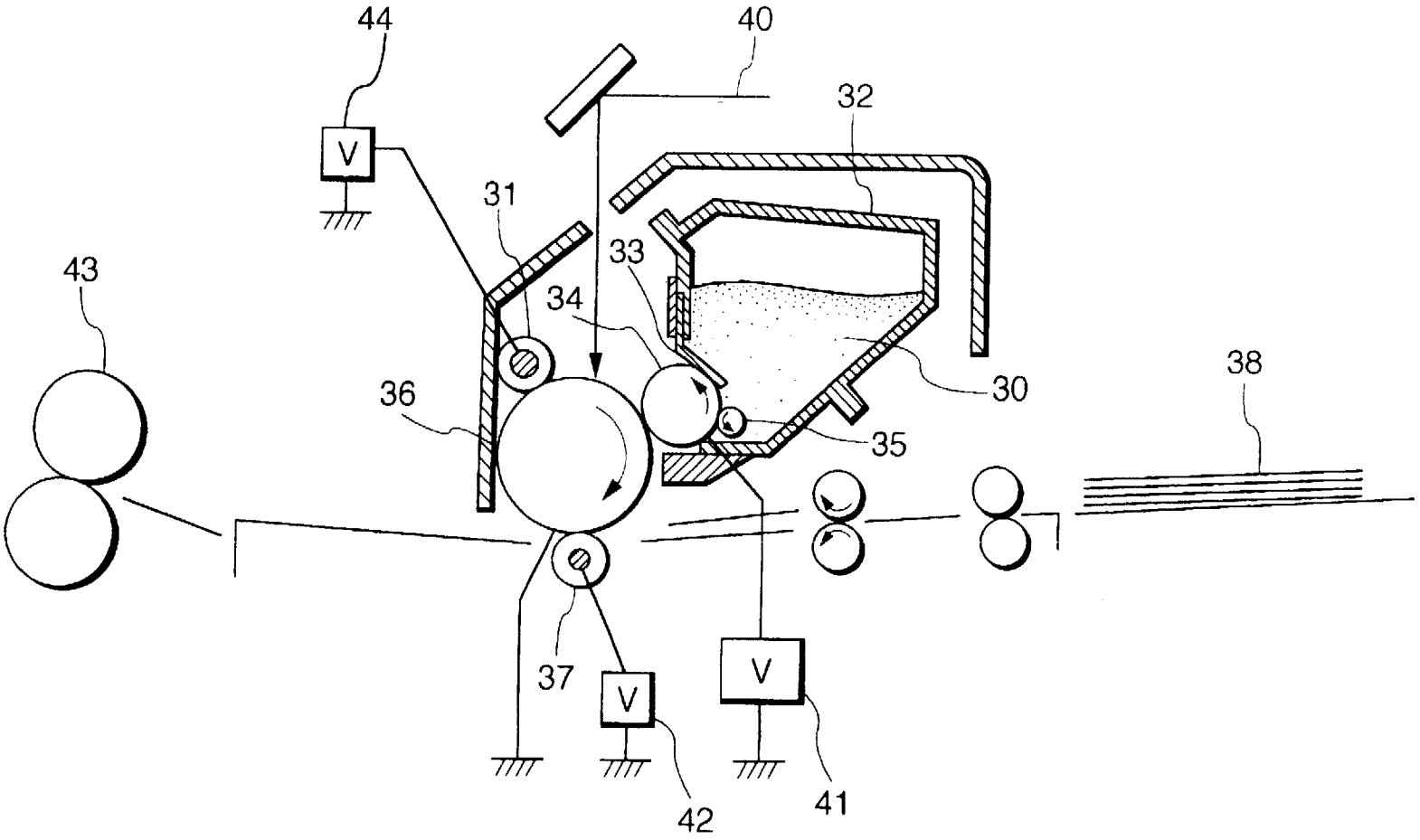
FIG. 1 schematically illustrates an image forming apparatus for carrying out a cleanerless image forming method having a cleaning-at-development system.

The principle of a cleanerless image forming method employing the cleaning-at-development system will be described. The principle thereof is the control of charge polarity and charge quantity of the toner on the photosensitive member in each electrophotographic step and the use of reverse development.

When a negatively chargeable photosensitive member and a negatively chargeable toner are used, the developed image is transferred to a transfer medium by means of a transfer member of positive polarity. The charge polarity of the residual toner varies from positive to negative depending on the relationship between the type (differences in thickness, resistance, dielectric constant and so forth) of the transfer medium and the image area. However, even if the polarity of the residual toner have turned positive during the transfer step, when the negatively chargeable photosensitive member is negatively charged by the negatively charging means, the charge polarity of the residual toner can be uniformly negative. Hence, when the reverse development is used, the residual toner having been negatively charged remains on the light potential areas to be developed and, at the dark potential areas not to be developed, the residual toner is attracted toward the developer carrying member because of the development electric field, so that no toner remains on the dark potential areas.

The matter will be described in greater detail with reference to FIG. 3.

By the use a negatively charged toner of a developer containing the toner and a carrier, being carried on a developer carrying member (a developing roller) 1, an electrostatic latent image formed on a negatively chargeable photosensitive member 2 is reverse-developed to obtain a toner image. The toner image on the photosensitive member is transferred to a transfer medium 4 by means of a corona charging assembly 3 to which a positive bias is applied. The toner not completely transferred to the transfer medium remains on the photosensitive member 2 as the residual toner.

This residual toner contains toner particles whose polarity has turned positive on account of the positive-polarity transfer bias applied thereto. When the surface of the photosensitive member 2 is charged to the negative polarity by means of the corona charging assembly 5, all residual toner converts to the negative polarity.

Thus, the toner on the photosensitive member 2 having passed through the corona charging assembly 5, as well as the photosensitive member, is uniformly charged to negative polarity.

Then, an electrostatic latent image is formed by imagewise exposure 6, and the electrostatic latent image formed on the photosensitive member 2 is developed by the developing roller 1 that carries the developer thereon. In the reverse development, imagewise exposed areas (light potential areas) are developed, while the bias applied to the developing roller is controlled to be between the potentials of unexposed area and exposed area on the photosensitive member so that the negatively charged toner present on the unexposed areas (dark potential areas) is attracted by the electrostatic force toward the developer. Thus, the residual toner (remaining after transfer) can be collected.

On the negative-polarity toner present on the exposed areas, a force acts to make it remain on the photosensitive member surface. Since the exposed areas are areas on which the toner image is formed, no problem may arise.

In the image forming apparatus as shown in FIG. 1, a charging roller 31 is used as a means for charging the surface of a photosensitive member 36 to the negative polarity, and a transfer roller 37 to which a positive bias is applied is used as a transfer charging means.

As described above, by controlling the charge polarity of the residual toner, it is possible to carry out the cleanerless image forming method using cleaning-at-development. However, it has been found that, in the step of controlling the charge polarity of the residual toner, the residual toner undergoes deterioration or acceleration of deterioration to cause a lowering of image quality.

Such deterioration occurs when, for example, a corona charging assembly is used as a photosensitive member charging means, where ions generated from the corona charging assembly are led to the photosensitive member surface and adhere to the photosensitive member surface, whereupon the photosensitive member surface has a potential. At this point, if the residual toner is present on the photosensitive member, the residual toner is at the same time charged to the same polarity as with the photosensitive member as a result of its exposure to a corona shower. These ions are considered to have a very high chemical activity. When such ions damages the surface of the photosensitive member and the resistivity of the photosensitive member surface becomes low, the electrostatic latent image is easily disturbed. As a result, so called smeared image tends to occur.

In the direct charging of, where a photosensitive member having an organic photosensitive surface layer containing a polymeric component is electrostatically charged in contact with a charging member, molecular chains of the polymeric component tend to be cut.

Studies made by the present inventors on the effect of the corona shower or discharge upon the residual toner in the cleanerless image forming method using cleaning-at-development have revealed that the residual toner passing through the photosensitive member charging assembly to control the charge polarity, is chemically affected, and this further affects running performance and image quality characteristics.

Conventionally, the residual toner is removed from the surface of the photosensitive member by a cleaning member such as a cleaning blade or a cleaning fur brush, and it is considered that the charging of the photosensitive member does not affected the toner. Hence, no studies have been made taking account of the fact that the charging may chemically affect the residual toner present on the photosensitive member.

However, since in the cleanerless image forming method using cleaning-at-development, the residual toner affected by the photosensitive member charging means is collected to the developing assembly and used again, it must be taken into account that such toner is chemically affected.

The present inventors have made extensive studies and have succeeded in improving the running performance and image quality characteristics even if the toner containing residual monomers in the toner particles is used in the cleanerless image forming method using cleaning-at-development.

The action ascribable to the residual monomers is presumed as follows.

In the case of a toner mainly composed of a binder resin, a colorant and a charge control agent, the residual monomers are present in the toner particles, and affect the thermal behavior of the toner at its glass transition point or in the vicinity of the glass transition point. Since monomers are a low-molecular weight component, they act to plasticize the whole toner. In the residual toner exposed to charge in the step of charging the photosensitive member, the binder resin is affected by the charging on account of the active species produced in the charging step, and a resin decomposition product is formed, where the decomposition product is presumed either to be present there as the low-molecular weight component, or to start polymerization reaction. Meanwhile, the residual monomers in the toner particles are presumed to be activated by the active species produced in the charging step.

Thus, since reactive low-molecular weight components are present in the toner, these are presumed to contend or compete with each other. The charge control agent contained in the toner particles is also a compound relatively rich in the donation and attraction of electrons. Although no clear cause has been completely understood, the relationship between the quantity of residual monomers and the contention or competition of reactive low-molecular weight components in toner particles may change due to the charge controlling agent.

Gradual changes in surface properties of toner particles tend to cause changes in fluidity and charging performance of the toner, and to cause the problems of changes in image density, occurrence of fog, filming and so forth as a result of running. Analyzing the development from the viewpoint of the quantity of residual monomers in toner particles, the toner can have a good running performance so long as the residual monomers are not more than 1,000 ppm. Use of a toner containing more than 1,000 ppm of residual monomer may result in lowering of running performance and image quality.

The quantity of the residual monomers may vary depending on the production methods of toners and binder resins. It has been long-awaited to provide a method that can well carry out the cleanerless image formation using cleaning-at-development even when the residual monomers are present in the toner to a certain extent. Taking account of the simplicity of producing toners and binder resins, the prevention of toner adhesion to the photosensitive member and the prevention of the deterioration of the photosensitive member due to the toner, the residual monomers may preferably be in an amount of from 5 to 500 ppm, and more preferably from 10 to 300 ppm.

The quantity of residual monomers in toner can be measured in the following way.

The quantity of residual monomers is measured by gas chromatography (GC) with an internal standard under the following conditions using a sample prepared by dissolving 0.2 g of a toner in 4 ml of tetrahydrofuran (THF).

GC conditions

Measuring apparatus: Shimadzu GC-15A

Carrier gas: $N_2$, 2 kg/cm$^2$, 50 ml/min.

Split ratio: 1:60

Linear velocity: 30 mm/sec.

Column: ULBON HR-1 50 m×0.25 mm

Temperature programming:

hold at 50° C., for 5 min;

rise to 100° C. by 5° C./min.;

rise to 200° C. by 10° C./min; and hold at 200° C.

Amount of sample: 2 μl

Standard sample: Toluene

In the present invention, a toner having a shape factor SF-1 of from 100 to 180, and SF-2 of from 100 to 140, is used. Its SF-1 may preferably be from 100 to 140, and more preferably from 100 to 130, and SF-2 may preferably be from 100 to 120, and more preferably from 100 to 115. The toner having such shape factors can be transferred in a good efficiency, and also effective to prevent transfer hollow in line images (blank area caused by poor transfer in line image). In particular, such a toner shows good durability against transfer hollow.

In the present invention, shape factor SF-1 is obtained as follows:

100 toner particles were chosen at random using FE-SEM (S-800; a scanning electron microscope manufactured by Hitachi Ltd.), and the image information is introduced in an image analyzer (LUZEX-III; manufactured by Nikore Co.) via an interface to make analysis. The value obtained in accordance with the following expression is defined as shape factor SF-1.

$$SF\text{-}1=(MXLNG)^2/AREA\times\pi/4\times100$$

wherein MXLNG represents an absolute maximum length of a toner particle, and AREA represents a projected area of a toner particle.

The shape factor SF-2 refers to a value obtained by calculation according to the following expression.

$$SF\text{-}2=(PERI)^2/AREA\times1/4\pi\times100$$

wherein PERI represents a peripheral length of a toner particle, and AREA represents a projected area of a toner particle.

The shape factor SF-1 indicates the degree of sphericity of the particle. SF-2 indicates the degree of irregularity of particle.

In order to enhance the transfer efficiency in the transfer step, thus to lessen the residual toner on the photosensitive member and the deterioration of the residual toner, it is preferable to make the surface of the photosensitive member have a contact angle with water of 85° or greater (preferably 90° or greater), and also preferable to make the shape of particles spherical and the surface area of toner particles small as much as possible, which means that the values of SF-1 and SF-2 should be small.

It is preferable to use toner particles produced by polymerization. In particular, toner particles of which surface was formed by polymerizing a monomer composition in a dispersion medium has reasonably smooth surfaces. Such toner particles with smooth surfaces having no sharp projection may not cause localization of the electric field. When the irregular particles of the residual toner pass through the step of the photosensitive member charging, the effect of the charging step is concentrated at the projections, and such portions tend to deteriorate specifically. On the other hand, when the toner particles have smooth surfaces, the electric fields may hardly localize at specific part of the toner particles. Toner particles having an SF-1 of 180 or more or an SF-2 of 140 or more may increase fog or lower the durability.

The toner may preferably contain toner particles having a capsule structure of a core and a shell. The core may be formed of a low temperature-softening substance and the shell may be formed by polymerization. This makes it possible to improve blocking resistance of the toner without damaging its low-temperature fixing performance, and to smooth the surface of the toner particles and make the shape of toner particles close to spheres. When only the shell rather than the whole particle is formed by polymerization, it is possible to control the residual monomers remaining in toner particles at a certain level in the processing step after the shell polymerization.

As a main component of the core, it is preferable to use a low-softening point substance. It is preferable to use a compound having a main endothermic peak (a melting point) within a temperature range of from 40° to 90° C. in the DSC (differential scanning calorimetry) curve measured according to ASTM D3418-8. If the maximum peak is present at a temperature lower than 40° C., the low-softening point substance may become weak in cohesion, undesirably resulting in reduction of high-temperature anti-offset properties. If the maximum peak is present at a temperature higher than 90° C., undesirably the fixing temperature becomes higher. If the endothermic peak is present at a high temperature, the low-softening point substance may undesirably precipitate during granulation in the aqueous medium when the toner particles are prepared by direct polymerization.

The temperature of the maximum endothermic peak is measured using, for example, DSC-7, manufactured by Perkin Elmer Co. The calibration of the temperature at the detection part of the apparatus is carried out based on the melting points of indium and zinc, and the calorie is calibrated based on the heat of fusion of indium. The sample is put in an aluminum pan and an empty pan is set as a control, to make measurement with a temperature rising at 10° C./min.

The low-softening point substance may include paraffin waxes, polyolefin waxes, Fischer-Tropsch waxes, amide waxes, higher fatty acids, ester waxes, and derivatives of these (e.g., grafted compounds or blocked compounds of these).

It is preferable to add the low-softening point substance in the toner in an amount of from 5 to 30% by weight. Its addition in an amount less than 5% by weight may cause a difficulty in the removal of the residual monomers and also may make the toner have poor low-temperature fixing performance. On the other hand, its addition in an amount more than 30% by weight may cause the coalescence of the toner particles during granulation, often producing toner particles having a broad particle size distribution.

The surfaces of the toner particles may be coated with an external additive so as to protect the toner particles from the influence of the photosensitive member charging member. In that sense, the toner particle surfaces may preferably be coated with the external additive at a coverage rate of from 5 to 99%, and more preferably from 10 to 99%. The coverage of the toner particle surfaces with the external additive is measured as follows. The external additive particles having a particle diameter of 5 nm or larger are subjected to the determination. Twenty toner particles are randomly chosen using FE-SEM (S-800; a scanning electron microscope manufactured by Hitachi Ltd.) with ×50,000 magnification, and their image information is introduced in an image analyzer (LUZEX-III; manufactured by Nikore Co.) via an interface to make analysis and calculate the coverage rate.

The toner used in the present invention may usually have a weight average particle diameter of from 2 to 12 μm, and preferably from 3 to 9 μm.

The external additive used in the present invention may preferably have a particle diameter not larger than 1/10 of the weight average particle diameter of the toner particles, in view of its durability when added to the toner. The particle diameter of the external additive refers to an average particle diameter obtained by observing the toner particles with the electron microscope (magnified 50,000 times). As the external additive, for example, the following material may be used.

It may include fine powders of metal oxides such as aluminum oxide, titanium oxide, strontium titanate, cerium oxide, magnesium oxide, chromium oxide, tin oxide and zinc oxide; nitrides such as silicon nitride; carbides such as silicon carbide; metal salts such as calcium sulfate, barium sulfate and calcium carbonate; fatty acid metal salts such as zinc stearate and calcium stearate; carbon black; and silica.

Any of these external additives may be used in an amount of from 0.01 to 10 parts by weight, and preferably from 0.05 to 5 parts by weight, based on 100 parts by weight of the toner particles. These external additives may be used alone or in combination. An external additive subjected to hydrophobic modification is more preferred.

Toner particles may be produced by a method in which a resin, a release agent comprised of a low-softening substance, a colorant, a charge control agent and so forth are melt-kneaded using a pressure kneader or extruder or a media dispersion machine for uniform dispersion, thereafter the kneaded product is cooled and collided against a target by a mechanical means or in a jet stream so as to be finely pulverized to have a desired toner particle diameter, and thereafter the pulverized product is further brought to a classification step to make its particle size distribution sharp to produce toner particles. There is another method as disclosed in Japanese Patent Publication No. 56-13945, in which a melt-kneaded product is atomized in the air by means of a disk or a multiple fluid nozzle to obtain spherical toner particles. Also there are method disclosed in Japanese Patent Publication No. 36-10231, Patent Applications Laid-open No. 59-53856 and No. 59-61842, such as suspension polymerization where toner particles are directly produced from a polymerizable monomer composition; dispersion polymerization where toner particles are directly produced using an aqueous organic solvent capable of dissolving polymerizable monomers and not capable of dissolving the resulting polymer; emulsion polymerization method such as soap-free polymerization where toner particles are produced by direct polymerization of polymerizable monomers in the presence of a water-soluble polar polymerization initiator.

In the present invention, the toner particles may particularly preferably be produced by the suspension polymerization under normal pressure or under application of a pressure, which can control the shape factor SF-1 in the range of from 100 to 180, and SF-2, from 100 to 140, and can rather easily obtain a fine-particle toner having a sharp particle size distribution and a particle diameter of from 4 to 8 μm. To encapsulate the low-softening substance, the polarity of the low-softening substance in the aqueous medium is made smaller than that of the main polymerizable monomers and also a small amount of resin or polymerizable monomer of a great polarity is added. Thus, toner particles having the core/shell structure wherein the low-softening substance is covered with the shell resin can be obtained. The particle size distribution and particle diameter of the toner particles may be controlled by changing the types and amounts of a water-insoluble inorganic salt and a dispersant having the action of protective colloids, or by controlling the conditions for agitation in a mechanical agitator (e.g., the peripheral speed of a rotor, pass times, and the shape of agitating blades), the shape of a reaction vessel, or the concentration of solid matter in the aqueous medium, whereby the desired toner particles can be obtained.

Cross sections of the toner particles can be observed by, for example, a method in which toner particles are well dispersed in a resin curable at room temperature, and after curing at 40° C. for 2 days, the cured product is dyed with triruthenium tetraoxide (optionally in combination with triosmium tetraoxide), thereafter thin slices are made by a microtome having a diamond cutter to observe the cross sections of toner particles with a transmission electron microscope (TEM). It is preferable to use the triruthenium tetraoxide dyeing method in order to make a contrast based on the difference in crystallinity between the low-softening substance used and the resin constituting the shell.

The resin used in the present invention to form the shell may include a styrene-acrylate or methacrylate copolymer, polyester resins, epoxy resins and a styrene-butadiene copolymer. In the method in which the toner particles are directly obtained by polymerization, the monomers for constituting any of these are used. Stated specifically, preferably used are styrene; styrene type monomers such as o-, m- or p-methylstyrene, and m- or p-ethylstyrene; acrylic or methacrylic acid ester monomers such as methyl acrylate or methacrylate, ethyl acrylate or methacrylate, propyl acrylate or methacrylate, butyl acrylate or methacrylate, octyl acrylate or methacrylate, dodecyl acrylate or methacrylate, stearyl acrylate or methacrylate, behenyl acrylate or methacrylate, 2-ethylhexyl acrylate or methacrylate, dimethylaminoethyl acrylate or methacrylate, and diethylaminoethyl acrylate or methacrylate; and olefin monomers such as butadiene, isoprene, cyclohexene, acrylo- or methacrylonitrile and acrylic acid amide. Any of these may be used alone, or usually used in the form of an appropriate mixture of monomers so mixed that the theoretical glass transition temperature (Tg) as described in a publication *POLYMER HANDBOOK*, 2nd Edition III, pp. 139–192 (John Wiley & Sons, Inc.) ranges from 40° to 75° C. If the theoretical glass transition temperature is lower than 40° C., problems may arise in respect of storage stability or running durability of the toner. If it is higher than 75° C., the fixing point of the toner may become higher. Especially in the case of color toners used to form full-color images, the color mixing performance of the respective color toners at the time of fixing may lower, resulting in a poor color reproducibility, and also the transparency of OHP images may lower. Thus, such temperatures are not preferable.

Molecular weight of the shell resin is measured by gel permeation chromatography (GPC). For GPC measurement, the toner is beforehand extracted with a toluene solvent for 20 hours by means of a Soxhlet extractor, and thereafter the toluene is evaporated by means of a rotary evaporator, and the residue is thoroughly washed with an organic solvent capable of dissolving the low-softening substance but dissolving no shell resin (e.g., chloroform) and dissolved in tetrahydrofuran (THF). The solution was then filtered with a solvent-resistant membrane filter of 0.3 μm in pore size to obtain a sample. Molecular weight of the sample is measured using 150C, manufactured by Waters Co. As the column constitution, A-801, A-802, A-803, A-804, A-805, A-806 and A-807, available from Showa Denko K.K., are connected, and molecular weight distribution can be measured using a calibration curve with polystyrene standard resins. The shell resin component may preferably have a number average molecular weight (Mn) of from 5,000 to 1,000,000, and the ratio of weight average molecular weight (Mw) to number average molecular weight (Mn), Mw/Mn, of 2 to 100.

When the toner particles having such core/shell structure are produced to encapsulate the low-softening substance, it is particularly preferable to further add a polar resin as an additional shell resin. As the polar resin used in the present invention, copolymers of styrene with acrylic or methacrylic acid, maleic acid copolymers, polyester resins (e.g., saturated polyester resin) and epoxy resins are preferably used.

It is particularly preferable for the polar resin not to contain in the molecule any unsaturated groups that may react with polymerizable monomers. If a polar resin having such unsaturated groups is contained, cross-linking reaction will take place with the polymerizable monomers that form the shell, so that the shell resin comes to have so high molecular weight that the toners are not suitable for full-color image formation in view of the color mixture of four color toners. Thus, such a resin is not preferable.

In the present invention, the surfaces of the toner particles may be further provided with an outermost shell resin layer.

Such an outermost shell resin layer may preferably be designed to have a glass transition temperature higher than that of the shell resin in order to improve blocking resistance more. The outermost shell resin layer may also preferably be cross-linked to an extent not to damage the fixing performance. The outermost shell resin layer may preferably contain a polar resin or a charge control agent in order to improve charging performance.

There are no particular limitations on how to provide the outermost shell resin layer. For example, it may be provided by a method including the following.

1) A method in which, at the latter half or after the completion of polymerization reaction, a monomer composition containing the polar resin, the charge control agent, a cross-linking agent etc. dispersed or dissolved therein if necessary, is added to the reaction system and adsorbed on polymerized particles, followed by the addition of a polymerization initiator to carry out polymerization.
2) A method in which emulsion polymerization particles or soap-free polymerization particles are separately produced from a monomer composition containing the polar resin, the charge control agent, a cross-linking agent and so forth as required, and they are added in the reaction system to cohere on the surfaces of polymerization particles, optionally followed by heating to fix them.
3) A method in which emulsion polymerization particles or soap-free polymerization particles produced from a monomer composition containing the polar resin, the charge control agent, a cross-linking agent and so forth as required are mechanically attached and fixed to the surfaces of toner particles in a dry system.

As a black colorant used in the present invention, carbon black, magnetic materials, a black-toned colorant prepared from later mentioned yellow, magenta and cyan colorants are used.

As a yellow colorant, compounds typified by condensation azo compounds, isoindolinone compounds, anthraquinone compounds, azo metal complexes, methine compounds and allylamide compounds are used. Stated specifically, C.I. Pigment Yellow 12, 13, 14, 15, 17, 62, 74, 83, 93, 94, 95, 97, 109, 110, 111, 128, 129, 147, 168, etc., are preferably used.

As a magenta colorant, condensation azo compounds, diketopyropyyrole compounds, anthraquinone compounds, quinacridone compounds, basic dye lake compounds, naphthol compounds, benzimidazolone compounds, thioindigo compounds and perylene compounds are used. Stated specifically, C.I. Pigment Red 2, 3, 5, 6, 7, 23, 48:2, 48:3, 48:4, 57:1, 81:1, 144, 146, 166, 169, 177, 184, 185, 202, 206, 220, 221 and 254 are particularly preferable.

As a cyan colorant, copper phthalocyanine compounds and derivatives thereof, anthraquinone compounds and basic dye lake compounds may be used. Stated specifically, C.I. Pigment Blue 1, 7, 15:1, 15:2, 15:3, 15:4, 60, 62, 66, etc. may be particularly preferably used.

These colorants may be used alone, in the form of a mixture, or in the state of a solid solution. The colorants are selected taking account of hue angle, chroma, brightness, weatherability, transparency on OHP films and dispersibility in toner particles. The colorant may preferably be used in an amount of from 1 to 20 parts by weight based on 100 parts by weight of the binder resin.

In the case when a magnetic material is used as the black colorant, it may preferably be used in an amount of from 40 to 150 parts by weight based on 100 parts by weight of the binder resin, which is different from the amount of other colorant.

As charge control agents, known agents may be used. It is preferable to use charge control agents that are colorless, and enables high speed charging and steady maintenance of constant charge for the toner. When the direct polymerization method is used to obtain the toner particles, charge control agents which do not inhibit polymerization and not soluble in the aqueous dispersion medium are particularly preferred. As negative charge control agents, they may include, metal compounds of aromatic carboxylic acids such as salicylic acid, naphthoic acid and dicarboxylic acids, polymer type compounds having sulfonic acid or carboxylic acid in the side chain, boron compounds, urea compounds, silicon compounds, and carycsarene. As positive charge control agents, they may include quaternary ammonium salts, polymer type compounds having such a quaternary ammonium salt in the side chain, guanidine compounds, and imidazole compounds. Any of these charge control agent may preferably be used in a amount of from 0.5 to 10 parts by weight based on 100 parts by weight of the binder resin. In the present invention, however, the addition of the charge control agent is not essential. When two-component development is employed, the triboelectric charging with a carrier can be utilized, and when non-magnetic one-component blade coating development is employed, the triboelectric charging with a blade member or sleeve member can be intentionally utilized. In either case, the charge control agent is not necessarily contained in the toner particles.

When the direct polymerization is used for producing the toner particles, the polymerization initiator to be used may include, for example, azo or diazo type polymerization initiators such as 2,2'-azobis-(2,4-dimethylvaleronitrile), 2,2'-azobisisobutyronitrile), 1,1'-azobis-(cyclohexane-1-carbonitrile), 2,2'-azobis-4-methoxy-2,4-dimethylvaleronitrile and azobisisobutyronitrile; and peroxide type polymerization initiators such as benzoyl peroxide, methyl ethyl ketone peroxide, diisopropylperoxy carbonate, cumene hydroperoxide, 2,4-dichlorobenzoyl peroxide and lauroyl peroxide. The polymerization initiator may usually be used in an amount of from 0.5 to 20% by weight based on the weight of the polymerizable monomers, which varies depending on the intended degree of polymerization. The type of the polymerization initiator varies according to the polymerization method a little, and may be used alone or in a mixture, considering the 10-hour half-life temperature.

In order to control the degree of polymerization, any known cross-linking agent, chain transfer agent and polymerization inhibitor may be further added.

When the suspension polymerization is used to produce the toner particles, the dispersant used may include, as inorganic oxides, tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica and alumina. As organic compounds, it may include polyvinyl alcohol, gelatin, methyl cellulose, methyl hydroxypropyl cellulose, ethyl cellulose, carboxymethyl cellulose sodium salt, and starch. Any of the stabilizers may preferably be used in an amount of from 0.2 to 10.0 parts by weight based on 100 parts by weight of the polymerizable monomers.

As these dispersants, those commercially available may be used as they are. In order to obtain dispersed particles having a fine and uniform particle size, however, fine particles of the inorganic compound may be formed in the dispersion medium under high-speed agitation. For example, in the case of tricalcium phosphate, an aqueous sodium phosphate solution and an aqueous calcium chloride solution may be mixed under high-speed agitation to form fine particles of tricalcium phosphate, whereby a fine-particle dispersant preferable for the suspension polymerization can be obtained.

In order to make fine particles of these dispersants, 0.001 to 0.1% by weight of a surface active agent may be used in combination. Stated specifically, commercially available nonionic, anionic or cationic surface active agents can be used. For example, those preferably used are sodium dodecylbenzenesulfate, sodium tetradecylsulfate, sodium pentadecylsulfate, sodium octylsulfate, sodium oleate, sodium laurate, potassium stearate and calcium oleate.

When the direct polymerization (suspension polymerization) is used to produce the toner particles, the toner particles can be produced by a production process as described below.

Polymerizable monomers, the release agent of a low-softening substance, the colorant, the charge control agent, the polymerization initiator and other additives are uniformly dissolved or dispersed using a homogenizer, an ultrasonic dispersion machine or the like, to form a monomer composition, which is then dispersed in an aqueous medium containing a dispersion stabilizer, by means of a conventional stirrer, or a high-shear agitator such as a homomixer, a homogenizer or the like. Granulation is preferably carried out controlling the agitation speed and time so that droplets of the monomer composition can have the desired toner particle size. After the granulation, agitation may be carried out to such an extent that the particulate state is maintained and the settling of particles can be prevented by the action of the dispersion stabilizer. The polymerization may be carried out at 40° C. or above, usually from 50° to 90° C. At the latter half of the polymerization, the temperature may be raised, and also the aqueous medium may be removed in part from the reaction system during the latter half of the reaction or after the reaction has been completed, in order to remove unreacted polymerizable monomers, by-products and so forth, which is done to improve the running durability in the image forming method of the present invention. After the reaction has been completed, the toner particles formed are collected by washing and filtration, followed by drying. In such suspension polymerization, water may usually be used as the dispersion medium preferably in an amount of from 300 to 3,000 parts by weight based on 100 parts by weight of the monomer composition.

The average particle diameter and particle size distribution of the toner can be measured using a Coulter counter Model TA-II or Coulter Multisizer (manufactured by Coulter Electronics, Inc.). In the present invention, they are measured using Coulter Multisizer (manufactured by Coulter Electronics, Inc.). An interface (manufactured by Nikkaki k.k.) that outputs number distribution and volume distribution and a personal computer PC9801 (manufactured by NEC.) are connected. As an electrolytic solution, an aqueous 1% NaCl solution is prepared using first-grade sodium chloride. For example, ISOTON R-II (available from Coulter Scientific Japan Co.) may be used. Measurement is carried out by adding 0.1–5 ml of a surface active agent as a dispersant, preferably an alkylbenzene sulfonate, to 100–150 ml of the above aqueous electrolytic solution, and there added 2–20 mg of a sample to be measured. The electrolytic solution in which the sample has been suspended is subjected to dispersion for about 1–3 minutes in an ultrasonic dispersion machine. The volume distribution and number distribution are calculated by measuring the volume and number of toner particles of which particle diameter is not smaller than 2 μm using the Coulter Multisizer with an aperture of 100 μm. Then the volume-based weight average particle diameter (D4: the median of each channel is used as the representative value for each channel) and weight variation coefficient (S4) determined from volume distribution, the number-based length average particle diameter (D1) and length variation coefficient (S1) determined from number distribution, and the weight based coarse powder amount (particle diameters of 8.00 μm or larger) determined from the volume distribution and the weight-based fine powder amount (particle diameters of 5 μm or smaller) determined from the number distribution.

In the present invention, releasability is endowed to the surface of the photosensitive member to have a contact angle with water of 85° or greater. This can effectively reduce the quantity of the residual toner so that exposure light is little intercepted by the residual toner and negative ghost images can be substantially prevented. At the same time, the cleaning efficiency for the residual toner at the time of development can be improved, and positive ghost images can also be effectively prevented.

Figure 9:
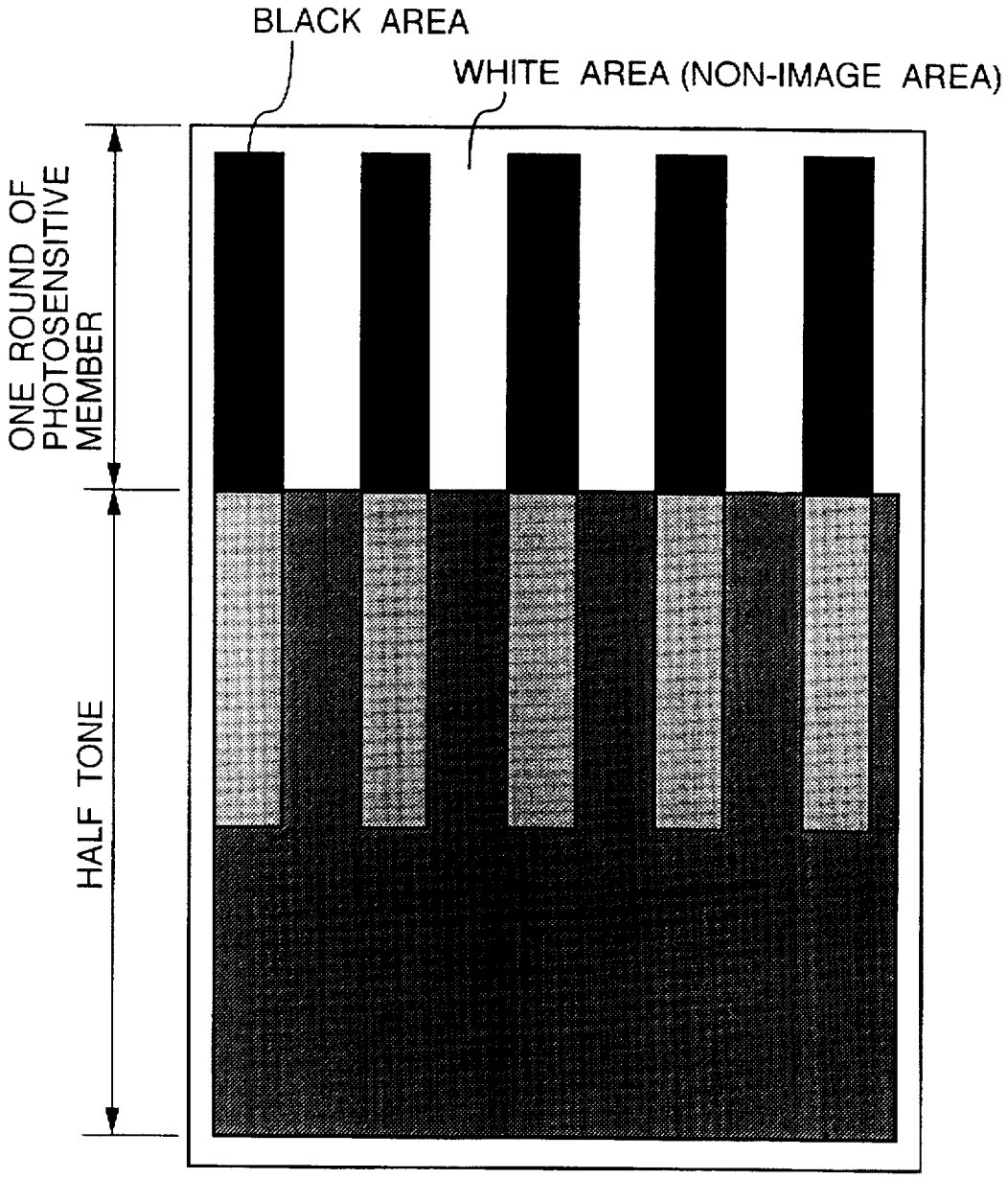
FIG. 9 is to illustrate ghost.

Ghost images occur in a mechanism as explained below. Interception of light by the residual toner becomes a problem especially when the surface of a photosensitive member is repeatedly used for one sheet of transfer medium (i.e., when the length corresponding to one round of the photosensitive member is shorter than the length of the transfer medium in the feed direction), where charging, exposure and development must be carried out in the presence of the residual toner on the photosensitive member, and hence the potential of the photosensitive member at the surface area where the residual toner is present does not completely drop, making development contrast insufficient. With reverse development, this appears on images as a negative ghost, as shown in FIG. 9, a lower image density than the neighborhood. Meanwhile, if the cleaning efficiency for the residual toner is insufficient at the time of development, the toner also develops the area of the photosensitive member surface where the residual toner is present, and hence appears a positive ghost having a higher image density than the neighborhood.

When the surface of the photosensitive member has a contact angle with water of 85° or greater (preferably 90° or greater), it is possible to prevent the surface deterioration of the photosensitive member and the deterioration of the toner even if monomers are remaining in the toner, and thus ghost images can be prevented from occurring. If the contact angle is smaller than 85°, the photosensitive member surface and the toner may deteriorate to cause ghost images according to the environment and the type of transfer mediums.

Figure 10:
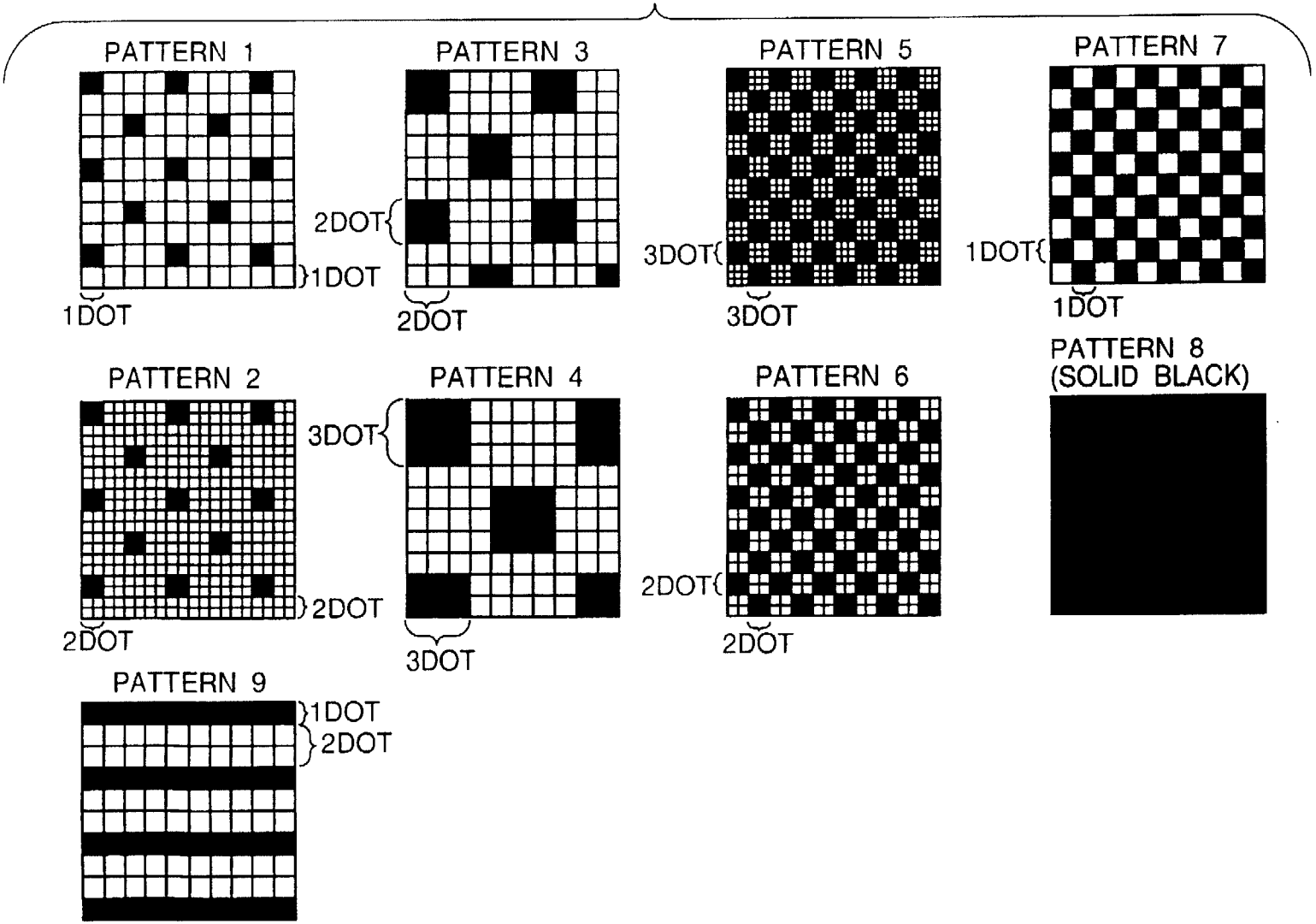
FIG. 10 schematically illustrates the dot patterns used to gradation evaluation.

The present invention provides an image forming method which can form graphic images with an excellent tone (gradation) reproduction in the cleaning-at-development system, not spoiling dot reproducibility of picture elements shown as patterns 1 to 6 in FIG. 10.

Figure 8:
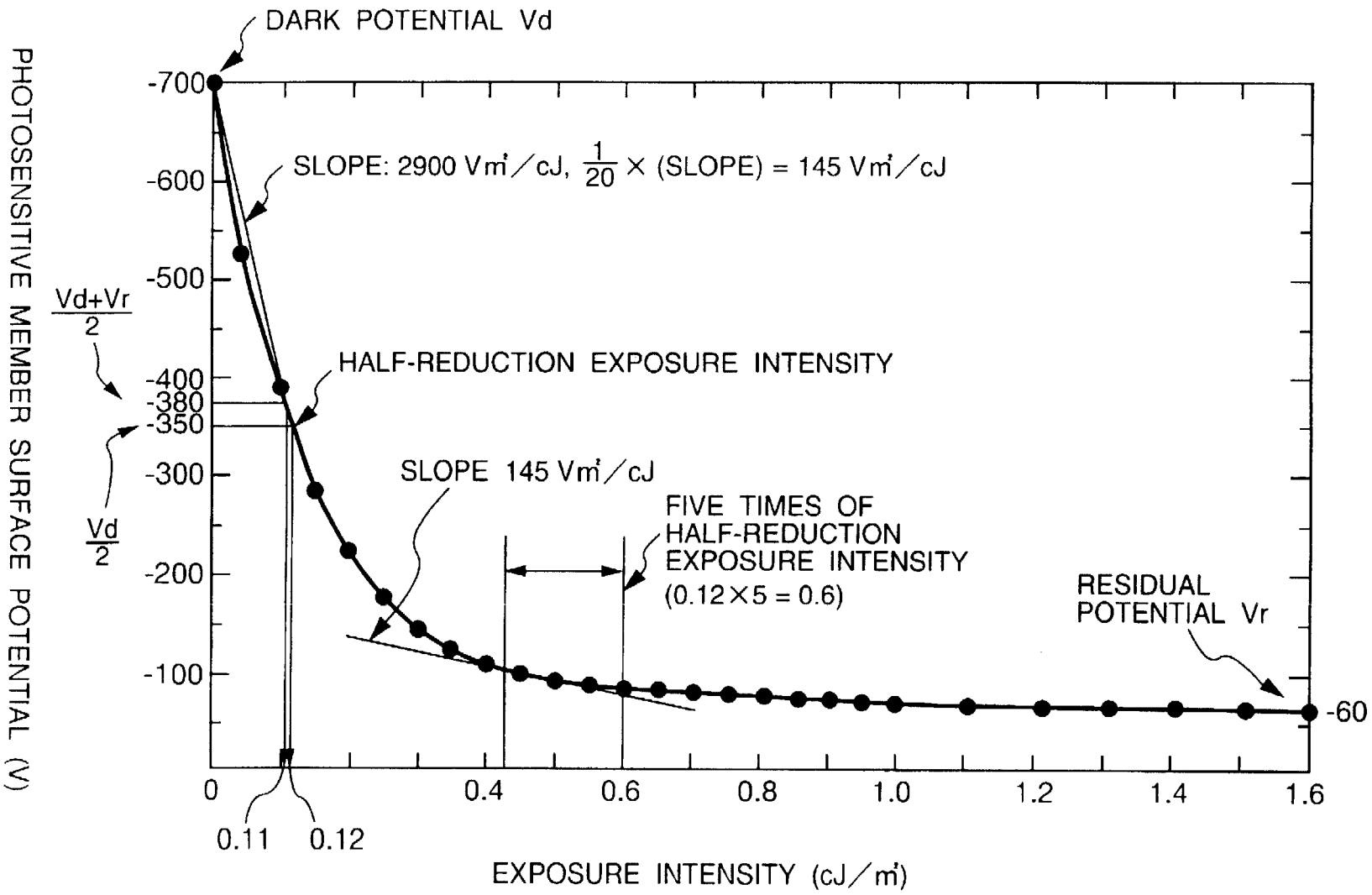
FIG. 8 shows a characteristic curve between exposure intensity and surface potential of a photosensitive member.

As a more preferred embodiment of the present invention, which has been found by the present inventors as a result of extensive studies, graphic images having a good dot reproducibility and tone reproduction can be obtained in the cleaning-at-development system, when electrostatic latent images are formed at a certain exposure intensity. Such a range of exposure intensity can be determined as follows. In the photosensitive member exposure intensity—surface potential characteristic curve as shown in FIG. 8, the slope of a straight line connecting a point of Vd and a point of (Vd+Vr)/2 is determined and the point of the curve of which tangent has a slope corresponding to 1/20 of the above slope is determined. The required exposure intensity is not lower than the intensity corresponding above point but not larger than the five times of the half reduction exposure intensity.

There is no particular preference to the method of exposure, but laser exposure is preferably used in view of smaller diameters of spots and in view of its power. If the amount of exposure is smaller than the above limitation, slim line images or smeared images tend to occur at line areas, and if it exceeds 5 times the half-reduction exposure intensity may undesirably cause the crush of isolated dots and poor tone reproduction in graphic images, although ghost image does not appear.

In the present invention, the dot reproducibility is improved when the photosensitive member is as sensitive as the half-reduction exposure intensity is 0.5 cJ/m$^2$ or lower. This is because, to cope with the interception of exposure due to the residual toner, the use of a photosensitive member having a relatively high sensitivity may suppress the variation of potential due to the exposure intensity in comparison with those having a relatively low sensitivity.

As an advantage of using a photosensitive member having a high sensitivity, there is the cooperative effect that the ghost can be further prevented from occurring. When the photosensitive member having a contact angle with water of 85° or greater is made to have a high sensitivity (i.e., a half reduction exposure intensity of 0.5 cJ/m$^2$ or lower), images free of ghost can be formed even on cardboard of about 200 g/m$^2$, and such a photosensitive member can be more preferably used in the cleaning-at-development system. Moreover, its use can be effective for preventing ghost from occurring under such conditions that the transfer performance may lower (e.g., in an environment of high temperature and high humidity or a transfer medium where the transfer is difficult).

When apparatus designing is considered, it is preferable that a value (coefficient):

(exposure intensity range)/(half reduction exposure intensity)

is large, because of broader room for the selection of exposure, where the exposure intensity range is determined as explained above. This coefficient may preferably be 0.7 or more, and more preferably 1.0 or more.

The exposure intensity-surface potential characteristic curve of a photosensitive member in the present invention is determined based on the values measured under process conditions of an apparatus in which the photosensitive member is actually used. The values are measured by a method in which a probe of a surface potentiometer is positioned just upstream the exposure position, and the potential of the photosensitive member to which no exposure is done is regarded as dark potential Vd, and next the exposure intensity is gradually changed to record the potentials on the photosensitive member during such changes. The half reduction exposure intensity is an exposure intensity at which the surface potential of the photosensitive member becomes half the Vd, i.e., Vd/2. The surface potential of the photosensitive member exposed to the light of 30 times as much as the half reduction exposure intensity is defined to be the residual potential Vr.

The exposure intensity-surface potential characteristic curve of the photosensitive member No. 1 as described later will be more specifically explained with reference to FIG. 8.

Photosensitive characteristics of the photosensitive member No. 1 are measured using a laser beam printer (LBP-860, manufactured by Canon Inc.) as an electrophotographic apparatus. Process speed is 70 mm/sec. The electrostatic latent images are formed at 300 dpi in a binary mode. DC voltage is applied to its charging roller.

The characteristics of the photosensitive member are measured by changing the amount of laser light (about 780 nm) while monitoring the potential. Here, laser exposure is applied over the whole surface under continuous irradiation in the secondary scanning direction.

In the photosensitive member No. 1, the change of the surface potential is measured at various exposure intensities to determine the exposure intensity-surface potential characteristic curve.

As shown in graph of FIG. 8, the dark potential (Vd) of the photosensitive member No. 1 is −700 V, and the residual potential (Vr) is −60 V. Therefore, (Vd+Vr)/2 is −380, where the exposure intensity is 0.11 cJ/m$^2$, and the slope of a straight line connecting the two points of potential −700 V and the potential −380 V is about 2.900 Vm$^2$/cJ. Therefore, the value of 1/20 of the slope 2.900 Vm$^2$/cJ is 145 Vm$^2$/cJ. At the point of contact between the straight line having the slope 145 Vm$^2$/cJ and the exposure intensity-surface potential characteristic curve intensity is 0.43 cJ/m$^2$. Meanwhile, the potential of ½ of the dark potential (Vd) of the photosensitive member No. 1 is −350 V, where the exposure intensity (i.e., the half reduction exposure intensity) is 0.12 cJ/m$^2$, and it follows that a value of the 5 times of the half reduction exposure intensity is 0.60 cJ/m$^2$. Therefore, the photosensitive member No. 1 is preferably set to have a light potential (Vl) of about −100 V at an exposure intensity of from 0.43 to 0.60 cJ/m$^2$.

The photosensitive member used in the present invention is effective when its surface is mainly constituted of a polymeric binder, for example, when a protective film mainly formed of a resin is provided on an inorganic photosensitive member such as an amorphous silicon or the like, when a surface layer formed of a charge transporting material and a resin is provided as a charge transport layer of a function-separated organic photosensitive member, and also when a protective layer is further formed on the charge transport layer.

As a means for imparting releasability to such an outermost layer, it may include the following: (i) a resin with a low surface energy is used in the resin itself that constitutes the outermost layer; (ii) an additive capable of imparting water repellency or lipophilic properties is added to the outermost layer; and (iii) a material having a high releasability is dispersed in the outermost layer in the form of powder.

In the case (i), the object can be achieved by introducing a fluorine-containing group and/or a silicon-containing group or the like into the structure of the resin. In the case (ii), it can be achieved by using a surface active agent as an additive. In the case (iii), a compound containing fluorine atoms (e.g., polyethylene tetrafluoride, polyvinylidene fluoride and carbon fluoride) may be used as the stated material. In particular, a polyethylene tetrafluoride powder is preferred. In the present invention, it is preferable to disperse a release powder such as fluorine-containing resin powder in the outermost layer.

It is preferable for the photosensitive member for electrophotography that a material having fluorine atoms and/or silicon atoms is present in its surface and also these atoms are in the ratios:

F/C=0.03 to 1.00

Si/C=0.03 to 1.00 as measured by X-ray photoelectron spectroscopy (XPS).

In the photosensitive member containing a material containing fluorine atoms, the desired potential can be obtained with a little charging electric current, when its dielectric constant is substantially low. This is effective for reducing the influence to the residual toner. In the photosensitive member containing a material containing silicon atoms, the silicon-containing material is present near the surface and improves the efficiency of collecting the residual toner at the development area, thus effectively lowering the frequency for the same toner particles to be repeatedly exposed to the charging of the photosensitive member, thereby effectively preventing the toner deterioration. The same effect can be said for the photosensitive member having the material containing fluorine element.

Stated specifically, a fluorine-substituted compound and/or a silicon-containing compound is/are incorporated in at least the binder resin to form the surface layer. More than one kind of the fluorine-substituted compound and/or the silicon-containing compound may be used, one is incompatible with the binder and the other is compatible or emulsifiable with the binder. The two kinds of fluorine-substituted compounds and/or silicon-containing compounds are present uniformly in the surface of the photosensitive member when they are used together. This makes it possible to lower the surface energy of the electrophotographic photosensitive member and to better solve the problems.

If the ratio of F/C or the ratio of Si/C is less than 0.03, the surface energy can be less effectively lowered. If it exceeds 1.00, the decrease in film strength or decrease in adhesiveness to the underlayer tends to occur.

The photosensitive member has at least a photosensitive layer on a conductive substrate, and the surface layer of the photosensitive layer may preferably contain at least the binder resin and the fluorine-substituted compound and/or the silicon-containing compound.

The fluorine-substituted compound may include carbon fluoride; polymers or copolymers of fluorine-containing monomers such as tetrafluoroethylene, hexafluoropropyelene, trifluoroethylene, chlorotrifluoroethylene, vinylidene fluoride, vinyl fluoride and perfluoroalkyl vinyl ethers, and graft polymers or block polymers containing any of these in the molecule; and fluorine-containing surface active agents. In the case of immiscible and powdery fluorine-substituted compounds, they may preferably have a particle diameter within the range of from 0.01 to 5 μm and an average molecular weight of from 3,000 to 5,000,000.

The silicon-containing compound may include block polymers or graft polymers containing a monomethylsiloxane three-dimensionally cross-linked product, a dimethylsiloxane-monomethylsiloxane three-dimensionally cross-linked product, an ultrahigh-molecular weight polydimethylsiloxane or a polydimethylsiloxane segment; silicon-containing surface active agents, silicon-containing macromonomers, and terminal-modified polydimethylsiloxane. In the case of a three-dimensionally cross-linked product, the compound is used in the form of fine particles, preferably having a particle diameter within the range of from 0.01 to 5 μm. In the case of a polydimethylsiloxane compound, the compound may preferably have an average molecular weight of from 3,000 to 5,000,000. In the case when the compound is in the form of fine particles, it is dispersed in the binder resin as a constituent of the photosensitive layer. As a means for dispersion, a sand mill, a ball mill, a roll mill, a homogenizer, a nanomizer, a paint shaker, an ultrasonic dispersion machine or the like may be used. The fluorine-substituted compound and/or a silicon-containing compound may be preferably contained in an amount of from 1 to 70% by weight, and more preferably from 2 to 55% by weight, in the outermost layer of the photosensitive member. If the compound(s) is/are in an amount less than 1% by weight, it is less effective to lower the surface energy or to prevent ghost. If in an amount more than 70% by weight, the film strength of the surface layer tends to lower or the amount of light incident on the photosensitive member tends to be small.

The binder resin in which the fluorine-substituted compound and/or a silicon-containing compound is/are dispersed may include polyester, polyurethane, polyacrylate, polyethylene, polystyrene, polybutadiene, polycarbonate, polyamide, polypropylene, polyimide, polyamidoimide, polysulfone, polyallyl ether, polyacetal, nylon, phenol resins, acrylic resins, silicone resins, epoxy resins, urea resins, allyl resins, alkyd resins and butyral resins. It is also possible to use reactive epoxy compounds and acrylic or methacrylic monomers or oligomers after they are mixed and then cured.

The photosensitive layer may have a single-layer or multi-layer structure. In the case of a single-layer structure, the generation and movement of the photocarriers occur in the same layer, and the fluorine-substituted compound and/or a silicon-containing compound is/are contained in this outermost layer. In the case of a multi-layer structure, a charge generation layer in which photocarriers are produced and a charge transport layer through which photocarriers move are layered. The layer that forms the surface layer may be either the charge generation layer or the charge transport layer. In either case, the fluorine-substituted compound and/or a silicon-containing compound is/are contained in the layer that forms the outermost layer. The single-layer photosensitive layer may preferably have a thickness of from 5 to 100 μm, and more preferably from 10 to 60 μm. A charge generating material or a charge transporting material may be contained in an amount of from 20 to 80% by weight, and more preferably from 30 to 70% by weight. In the case of the multi-layer photosensitive member, the charge generation layer may preferably have a layer thickness of from 0.001 to 6 μm, and more preferably from 0.01 to 2 μm. The multi-layer type photosensitive member may preferably have a charge generating material in an amount of from 10 to 100% by weight, and more preferably from 40 to 100% by weight. The multi-layer photosensitive member may preferably have the charge transport layer in a thickness of from 5 to 100 μm, and more preferably from 10 to 60 μm. The multi-layer type photosensitive member may preferably have a charge transporting material in an amount of from 20 to 80% by weight, and more preferably from 30 to 70% by weight.

The charge generating material may include phthalocyanine pigments, polycyclic quinone pigments, azo pigments, perylene pigments, indigo pigments, quinacridone pigments, azulenium dyes, squarilium dyes, cyanine dyes, pyrylium dyes, thiopyrylium dyes, xanthene dyes, quinoneimine dyes, triphenylmethane dyes, styryl dyes, selenium, selenium-tellurium, amorphous silicon, and cadmium sulfide. The charge transporting material may include pyrene compounds, carbazole compounds, hydrazone compounds, N,N-dialkylaniline compounds; diphenylamine compounds, triphenylamine compounds, triphenylmethane compounds, pyrazoline compounds, styryl compounds, and stilbene compounds.

The electrophotographic photosensitive member may have a protective layer superposed on the photosensitive layer. The protective layer may preferably have a layer thickness of from 0.01 to 20 μm, and more preferably from 0.1 to 10 μm. The protective layer may contain the charge generating material or charge transporting material described above, and a conductive material or the like such as a metal, an oxide thereof, a nitride, a salt, an alloy or carbon. The fluorine-substituted compound and/or a silicon-containing compound may be contained also in the protective layer serving as the outermost layer. As a binder resin used in the protective layer, it may include polyester, polyurethane, polyacrylate, polyethylene, polystyrene, polybutadiene, polycarbonate, polyamide, polypropylene, polyimide, polyamidoimide, polysulfone, polyallyl ether, polyacetal, nylon, phenol resins, acrylic resins, silicone resins, epoxy resins, urea resins, allyl resins, alkyd resins and butyral resins. It is also possible to use reactive epoxy compounds and acrylic or methacrylic monomers or oligomers after they are mixed and then cured.

As a material for the conductive substrate used in the electrophotographic photosensitive member, it may include metals such as iron, copper, nickel, aluminum, titanium, tin, antimony, indium, lead, zinc, gold and silver; alloys thereof; oxides thereof; carbon, and conductive resins. The conductive substrate may have the shape of a cylinder, a belt or a sheet. The conductive material for forming the conductive substrate may be molded, used as a coating material, or vacuum-deposited. A subbing layer may be formed between the conductive substrate and the photosensitive layer. The subbing layer is mainly formed of a binder resin, and may also contain the above conductive material or an acceptor. The binder resin that forms the subbing layer may include polyester, polyurethane, polyacrylate, polyethylene, polystyrene, polybutadiene, polycarbonate, polyamide, polypropylene, polyimide, polyamidoimide, polysulfone, polyallyl ether, polyacetal, nylon, phenol resins, acrylic resins, silicone resins, epoxy resins, urea resins, allyl resins, alkyd resins and butyral resins.

To produce the electrophotographic photosensitive member, a process such as vacuum deposition and coating is used. In coating, a bar coater, a knife coater, a roll coater, an attritor, a sprayer, dip coating, electrostatic coating, powder coating and so forth are used.

As a method for charging the photosensitive member, corona charging such as corotron or scorotron is used. Besides, pin electrode charging may be used. Direct charging may also be used.

As a contact charging member for the direct charging of the photosensitive member, it may include a brush, a roller and a blade. In the case of the roller or the blade, a metal such as iron, copper or stainless steel, a carbon-dispersed resin, or a resin in which a metal powder or metal oxide powder was dispersed is used. It may have the shape of a rod or a plate.

For example, when the contact charging member is an elastic roller, a member consisting of an elastic layer, a conductive layer and a resistance layer provided on a conductive substrate is used. The elastic layer may include rubber layers formed of chloroprene rubber, isoprene rubber, EPDM rubber, polyurethane rubber, epoxy rubber or butyl rubber, or spongy layers formed of any of these; and layers formed of a styrene-butadiene thermoplastic elastomer, a polyurethane thermoplastic elastomer, a polyester thermoplastic elastomer or an ethylene-vinyl acetate thermoplastic elastomer. The conductive layer may preferably have a volume resistivity of $10^7$ Ω·cm or below, and preferably $10^6$ Ω·cm or below. For example, a metal-deposited film, a conductive particle-dispersed resin layer or a conductive resin layer is used as the conductive layer. As specific examples, it may include deposited films of metals such as aluminum, indium, nickel, copper and iron; and layers formed of compositions prepared by dispersing conductive particles such as carbon, aluminum, nickel or titanium oxide particles in a resin such as urethane, polyester, a vinyl acetate-vinyl chloride copolymer or polymethyl methacrylate. The conductive resin may include quaternary ammonium salt-containing polymethyl methacrylate, polyvinyl aniline, polyvinyl pyrrole, polydiacetylene and polyethyleneimine. The resistance layer is a layer having a volume resistivity of 106 to $10^{12}$ Ω·cm, and a semiconductive resin, a conductive particle-dispersed insulating resin or the like may be used. As the semiconductive resin, resins such as ethyl cellulose, nitro cellulose, methoxymethylated nylon, ethoxymethylated nylon, copolymer nylon, polyvinyl hydrin and casein are used. As examples of the conductive particle-dispersed insulating resin, it may include resins prepared by dispersing conductive particles such as carbon, aluminum, indium oxide or titanium oxide particles in an insulating resin such as urethane, polyester, a vinyl acetate-vinyl chloride copolymer or polymethyl methacrylate.

The brush serving as the contact charging member may be comprised of a fiber commonly used and a conductive material dispersed therein for the purpose of resistance control. The fiber may include fibers of resin such as nylon, acrylic, rayon, polycarbonate or polyester. The conductive material may include conductive powders of metals such as copper, nickel, iron, aluminum, gold and silver; metal oxides such as iron oxide, lead oxide, tin oxide, antimony oxide and titanium oxide; and carbon black. The conductive powders may be optionally subjected to surface treatment for the purpose of hydrophobic modification or resistance control. These conductive powders are selected taking account of dispersibility and productivity. The contact charging brush may preferably have a fiber thickness of from 1 to 20 deniers (a fiber diameter of from 10 to 500 μm), a fiber length of from 1 to 15 mm and a brush density of from 10,000 to 300,000 threads per square inch ($1.5\times10^7$ to $4.5\times10^8$ threads per square meter) for use.

A contact transfer process applicable to the image forming method of the present invention will be described below.

Toner images are electrostatically transferred to a transfer medium by pressing a transfer means to the photosensitive member bearing an electrostatic latent image, interposing the transfer medium between them. The contact pressure may be 3 g/cm or higher, and more preferably 20 g/cm or higher in linear pressure.

A linear pressure which is lower than 3 g/cm as the contact pressure is not preferable since transport aberration of transfer mediums and poor transfer tend to occur.

As the transfer means in the contact transfer process, a device having a transfer roller or transfer belt is used. The transfer roller has at least a mandrel and a conductive elastic layer. The conductive elastic layer is formed of polyurethane or EPDM rubber with a conductive material such as carbon dispersed therein, and has a volume resistivity of from $10^6$ to $10^{10}$ Ω·cm.

As a developing method used in the present invention, the reverse development is preferably used. When a two-component magnetic brush developing method is used, magnetic ferrite particles, magnetite particles, iron powder, or any of these particles coated with a resin such as acrylic resin, silicone resin or fluorine resin are used as a magnetic carrier. Here, a DC or AC component bias is applied to the developer carrying member during development or blanking time before and after development controlling the potential to enable the collection of the residual toner present on the photosensitive member. The DC component used here may preferably be set so as to be between the light potential and the dark potential.

The one component developer method may be also used, where a toner may be applied to the surface of an elastic roller serving as the developer carrying member and the toner thus applied may be brought into contact with the surface of the photosensitive member. The toner may be either a magnetic toner or a non-magnetic toner. Here, in order to effect the cleaning-at-development by the aid of an electric field acting across the photosensitive member and the elastic roller facing the surface of the photosensitive member, the surface, or the vicinity of the surface, of the elastic roller is required to have a potential and have an electric field in the narrow gap between the surface of the photosensitive member and the surface of the elastic roller. For this purpose, the electric field may be maintained while preventing conduction to the photosensitive member surface by controlling the resistance of the elastic layer of the elastic roller, or a thin insulating layer may be provided as the surface layer of a conductive roller. In addition, a conductive roller on which surface in contact with the photosensitive member is coated with an insulating material to form an conductive resin sleeve, or an insulating sleeve having a conductive layer on its internal surface not coming into contact with the photosensitive member are possible.

When the one-component contact developing method is used, a toner carrying roller may be rotated in the same direction as the photosensitive member, or may be rotated in the opposite direction. When it is rotated in the same direction, it may preferably be rotated in a peripheral speed ratio of 100% or more, and more preferably 110% or more, of the peripheral speed of the photosensitive member. If it is less than 100%, the image quality level tends to lower. As the peripheral speed ratio increases, the quantity of the toner fed to the developing area increases, and more frequently the toner attaches and leaves the electrostatic latent image, repeating scraping off from the unnecessary part and imparting to the necessary part, so that an image faithful to the electrostatic latent image can be obtained. From the viewpoint of the cleaning-at-development, it can be expected to have an advantage that the residual toner having adhered onto the photosensitive member is physically taken off on account of the difference in peripheral speed between the photosensitive member surface and the developer carrying member and is collected by virtue of the electric field. Hence, a higher peripheral speed ratio is more favorable for the collection of the residual toner.

The image forming method of the present invention will be described with reference to FIGS. 1 to 4. FIG. 1 schematically illustrates an image forming apparatus having a process cartridge from which the cleaning unit having a cleaning blade or the like has been removed. A photosensitive member 36 is electrostatically charged by means of a charging roller 31 serving as the contact charging member, and image areas are exposed to laser light 40 to form an electrostatic latent image. A toner 30 held in a developing assembly is applied to a developer carrying member 34 by means of a toner coating roller 35 and a coating blade 34, and then the electrostatic latent image formed on the photosensitive member 36 is developed by reverse development, with the toner carried on the developer carrying member 34, to form a toner image on the photosensitive member 36. To the developer carrying member 34, at least a DC bias is applied through a bias applying means 41. The toner image on the photosensitive member 36 is transferred by means of a transfer roller 37 serving as the transfer means, to which a bias is applied through a bias applying means 42, onto a transfer medium 38 transported to the transfer zone. The toner image transferred onto the transfer medium is fixed through a heat-and-pressure fixing means 43 having a heating roller and a pressure roller.

In the present invention, a photosensitive member whose surface has a contact angle with water of 85° or greater (preferably 90° or greater) is used as the photosensitive member 36, and also a toner having a shape factor SF-1 of from 100 to 180 (preferably from 100 to 140), and SF-2 of from 100 to 140 (preferably from 100 to 120), is used as the toner. Hence, the transfer efficiency is superior to the prior art, and the amount of the residual toner on the photosensitive member 36 can be smaller. The residual toner, remaining on the photosensitive member after the transfer step, is transported to the place where the charging roller 31 stands, without the step of cleaning by a cleaning means such as a blade cleaning means. The photosensitive member 36 having the residual toner is electrostatically charged by the charging roller 31, and, after the charging, exposed to laser light 40, so that an electrostatic latent image is formed. On the photosensitive member 36 having the residual toner, the electrostatic latent image is developed by the toner carried on the developer carrying member 34 and at the same time the residual toner is collected to the developer carrying member 34. A toner image formed on the photosensitive member 36 having passed through the cleaning-at-development step is transferred by means of the transfer roller 37 onto another transfer medium 38 transported to the transfer zone. After the transfer step, the photosensitive member 36 is again electrostatically charged by means of the charging roller 31. A similar process is repeated thereafter.

In the reverse development, as developing conditions preferable for carrying out the cleaning-at-development, the dark potential (Vd) and light potential (Vl) on the surface of the photosensitive member and the direct bias (Vdc) applied to the developer carrying member are preferably set so as to satisfy the relationship:

$$|Vd-Vdc|>|Vl-Vdc|.$$

More preferably, the value of $|Vd-Vdc|$ is greater than the value of $|Vl-Vdc|$ by 10 V or more.

Figure 2:
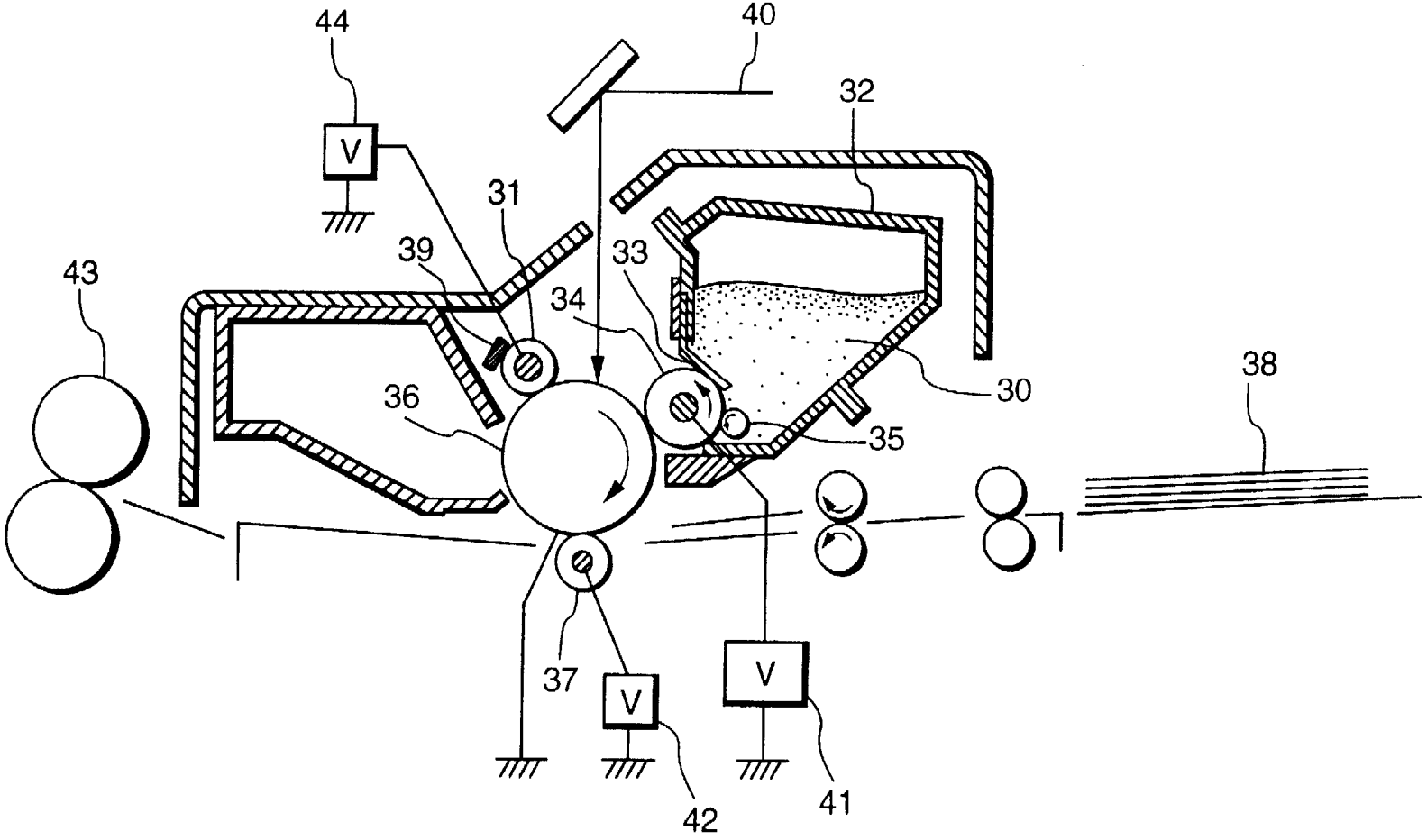
FIG. 2 schematically illustrates an image forming apparatus having a process cartridge from which a cleaning blade has been removed.

FIG. 2 schematically illustrates an image forming apparatus having a process cartridge from which a cleaning blade of a cleaner has been removed. A charging roller 31 is provided with a cleaning member for the charging roller, formed of a material such as non-woven fabric.

Figure 3:
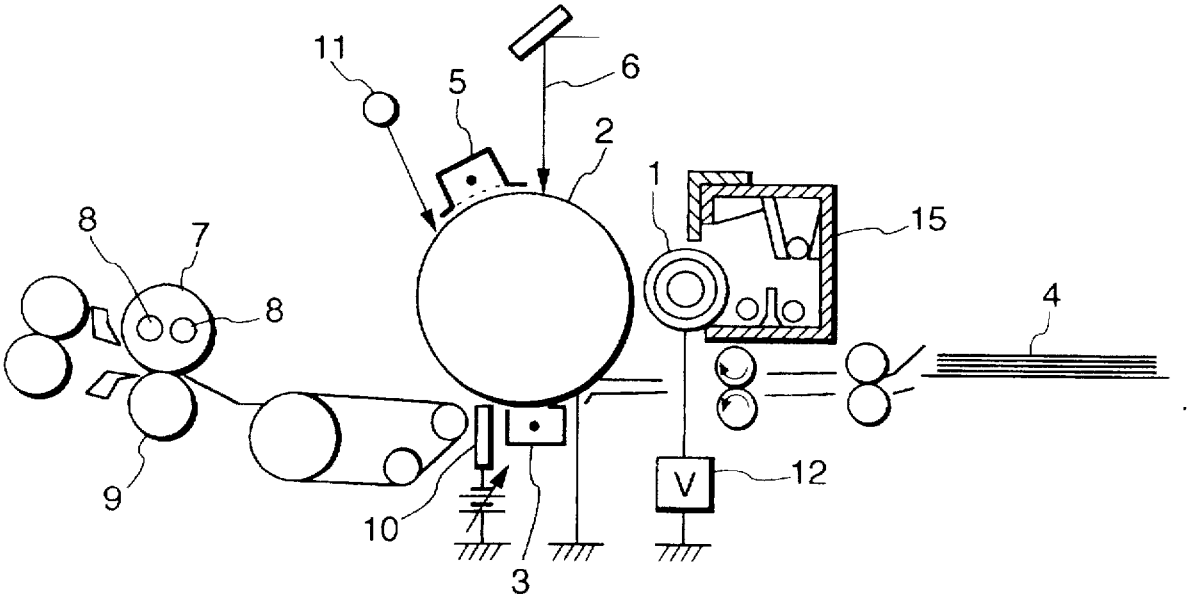
FIG. 3 schematically illustrates another image forming apparatus for carrying out a cleanerless image forming method having the cleaning-at-development system.

FIG. 3 schematically illustrates another image forming apparatus having a developing assembly making use of a two component developer for magnetic brush development.

In FIG. 3, a photosensitive member 2 is electrostatically charged by means of a corona charging assembly (not in contact with the photosensitive member 2) serving as a charging means for the photosensitive member 2, and an electrostatic latent image is formed on the photosensitive member 2 by analog exposure or laser light exposure 6. A magnetic brush of a two component developer consisting of a toner and a magnetic carrier, formed on a developer carrying member 1 of a developing assembly 15, is brought into contact with the photosensitive member 2, and the electrostatic latent image formed on the photosensitive member 2 is developed by reverse development to form a toner image. To the developer carrying member 1, at least a DC bias is applied from a bias applying means 12. The toner image on the photosensitive member 2 is transferred by means of a transfer corona charging assembly 3 (not in contact with the photosensitive member 2) serving as the transfer means, onto a transfer medium 4 transported to the transfer zone. After charge elimination through a charge eliminating means 10, the toner image transferred onto the transfer medium is fixed to the transfer medium 4 while passing through a heat-and-pressure fixing means having a heating roller 7 internally provided with a heater 8, and a pressure roller 9.

Also in the transfer step as shown in FIG. 3, a photosensitive member whose surface has a contact angle with water of 85° or greater (preferably 90° or greater) is used as the photosensitive member 2, and a toner having a shape factor SF-1 of from 100 to 180 (preferably from 100 to 140), and SF-2 of from 100 to 140 (preferably from 100 to 120), is used. Hence, the transfer efficiency is superior to the prior art, and the amount of the residual toner on the photosensitive member 2 can be smaller. The residual toner, remaining on the photosensitive member after the transfer step, does not pass through the cleaning step. The photosensitive member 2 destaticized by erase exposure 11 is again electrostatically charged by the corona charging assembly 5, and another electrostatic latent image is formed upon exposure 6. On the photosensitive member 2 carrying the residual toner, the electrostatic latent image is developed by the magnetic brush formed on the developer carrying member 1 and at the same time the residual toner is collected to the developer carrying member 34. The toner image formed on the photosensitive member 2 having passed through the cleaning-at-development step is transferred onto another transfer medium 4 transported to the transfer zone. After the transfer step, the photosensitive member 2 is destaticized by erase exposure 11, and is again electrostatically charged by means of the corona charging assembly 5. A similar process is repeated thereafter.

Figure 4:
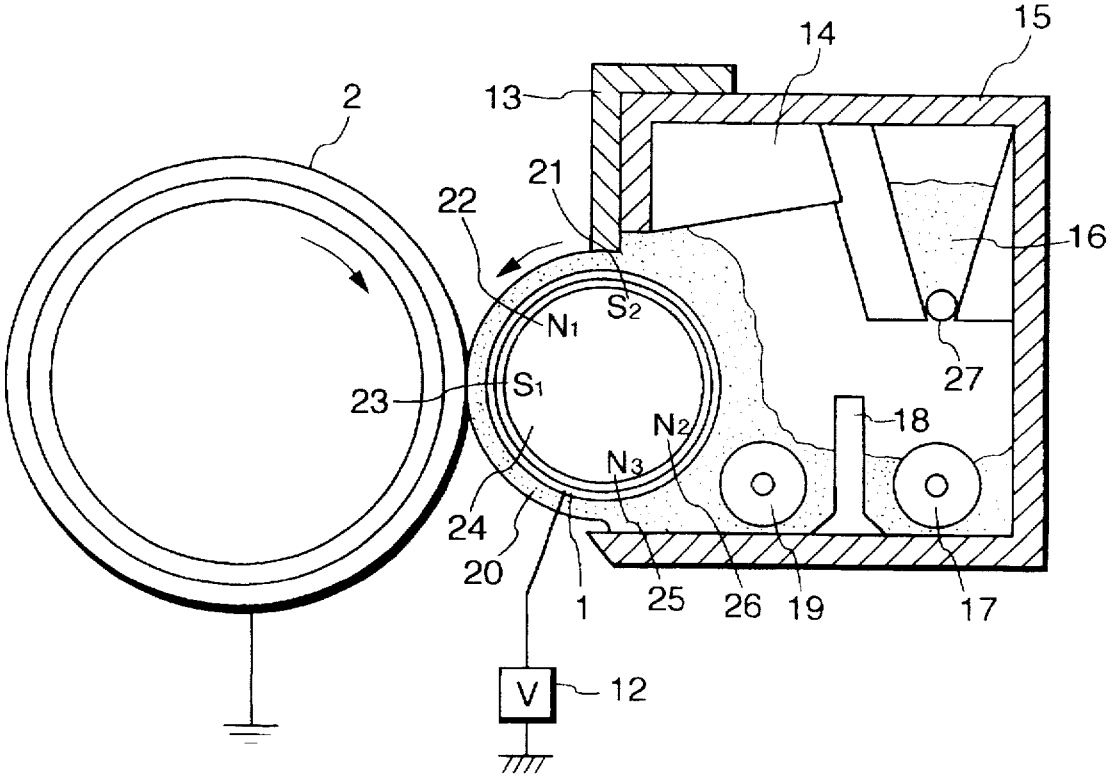
FIG. 4 is an enlarged view of developing components of the image forming apparatus shown in FIG. 3.
Figure 5:
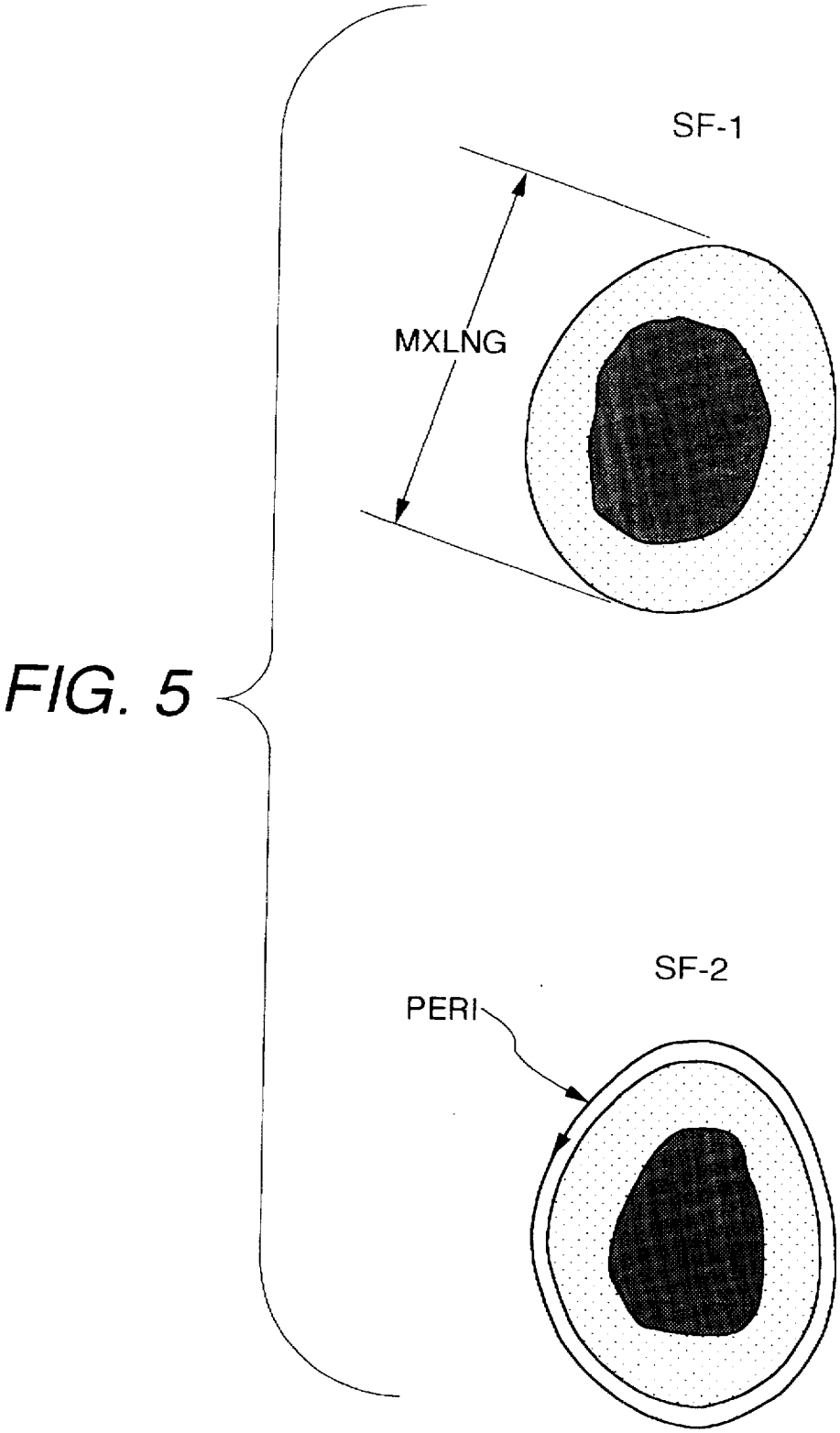
FIG. 5 is to explain the shape factors SF-1 and SF-2.

FIG. 4 shows an enlarged view of the developing components shown in FIG. 3. In FIG. 4, the photosensitive member 2 comes into contact with the magnetic brush of the two component developer 20 formed on the developer carrying member. The developer carrying member 1 is comprised of a non-magnetic material such as aluminum or SUS 316 stainless steel. The developer carrying member 1 is laterally provided in a rotatably supported state on a shaft at an oblong opening provided in the left lower wall of the developing assembly in the longitudinal direction of the developing assembly 15, in such a manner that the right half of its periphery is in the developing assembly 15, and the left half of the periphery is exposed to the outside of the container of the assembly. It rotates in the direction of an arrow.

Reference numeral 24 denotes a stationary permanent magnet serving as a means for generating stationary magnetic fields, provided inside the developer carrying member 1 and held at the position and posture as shown in the drawing, even when the developer carrying member 1 is rotatingly driven. This magnet 24 has five magnetic poles of north (N) magnetic poles 22, 25 and 26 and south (S) magnetic poles 21 and 23. The magnet 24 may be comprised of an electromagnet in place of the permanent magnet.

Reference numeral 13 denotes a non-magnetic blade serving as a developer control member, provided on the upper edge of the opening of a developer feeding device at which the developer carrying member 1 is disposed, in such a manner that its base is fixed on the side wall of the container. The blade is made of, for example, SUS316 stainless steel and bent in the L-form in its lateral cross section.

Reference numeral 14 denotes a magnetic carrier returning member the front surface of which is brought into contact with the inner surface of the lower side of the non-magnetic blade 13 and the forward bottom surface of which is made to serve as a developer guide surface. The part defined by the non-magnetic blade 13, the magnetic carrier returning member 14 and so forth is a control zone.

Reference numeral 20 denotes a developer layer consisting of the toner and the magnetic carrier. Reference numeral 16 denotes the non-magnetic toner.

Reference numeral 27 denotes a toner feed roller which is operated in accordance with the output from a toner density detecting sensor (not shown). As the sensor, it is possible to utilize a toner volume detecting system, an antenna system in which a piezoelectric device, an inductance variation detecting device and an alternating current bias are utilized, or a system by which an optical density is detected. The non-magnetic toner 16 is fed by the rotating or stopping of the roller. A fresh developer fed with the non-magnetic toner 16 is blended and agitated while it is transported by means of a developer transport screw 17. Hence, the fed toner is triboelectrically charged in the course of this transportation. Reference numeral 18 denotes a partition plate, which is cut out at the both ends of its longitudinal direction of the developing device, and at these cutouts the fresh developer transported by the screw 17 is delivered to another developer transport screw 19.

The north (N) magnetic pole 26 serves as a transport pole. It enables a recovered developer to be collected into the container after development has been carried out, and also the developer in the container to be transported to the control zone.

In the vicinity of the north (N) magnetic pole 26, the fresh developer transported by the roller 19 provided in proximity to the developer carrying member 1, and the developer collected after developing are interchanged.

The distance between the lower end of the non-magnetic blade 13 and the surface of the developer carrying member 1 may be in the range of from 100 to 900 μm and preferably from 150 to 800 μm. If this distance is smaller than 100 μm, the carrier particles tend to clog between them, which gives an uneven developer layer and causes insufficient developer supply for carrying out good development, bringing about only developed images with low density and much unevenness in some cases. If it is larger than 900 μm, the quantity of the developer applied to the developer carrying member 1 may increase to make it impossible to control the developer layer to have a given thickness, so that magnetic particles may adhere to the electrostatic image bearing member 11 in a large quantity and at the same time the circulation of developer and the development control by the magnetic carrier returning member 14 may become weak, resulting in fogging due to the triboelectricity deficiency.

The thickness of the developer layer on the developer carrying member 1 may preferably be made a little larger than the opening gap distance between the developer carrying member 1 and the photosensitive member 2. This distance may preferably be from 50 to 800 μm, and more preferably from 100 to 700 μm.

The present invention will be described below in greater detail by giving specific examples for producing the toner and the photosensitive member, working examples, and comparative examples. In the following, "part(s)" refers to "part(s) by weight".

Polymerization Toner, Production Example A

Into 710 parts of ion-exchanged water, 450 parts of an aqueous 0.1 M-Na3PO4 solution was added, and heated to 60° C. Stirring at 12,000 rpm using a TK-type homomixer (manufactured by Tokushu Kika Kogyo Co., Ltd.), 68 parts of an aqueous 1.0 M-$CaCl_2$ solution was added thereto little by little to obtain an aqueous medium containing fine particles of $Ca_3(PO_4)_2$.

Meanwhile, following materials were heated to 60° C., and uniformly dissolved and dispersed using a TK-type homomixer (manufactured by Tokushu Kika Kogyo Co., Ltd.) at 12,000 rpm.

| | |
|---|---|
| Styrene (monomer) | 165 parts |
| n-Butyl acrylate (monomer) | 35 parts |
| C.I. Pigment Blue 15:3 (colorant) | 15 parts |
| Dialkylsalicylic acid metal compound (negative charge control agent) | 3 parts |
| Saturated polyester (polar resin; acid value: 14; peak molecular weight: 8,000) | 10 parts |
| Ester wax (release agent; melting point: 70° C.) | 50 parts |

In the mixture obtained, 10 parts of a polymerization initiator 2,2'-azobis(2,4-dimethylvaleronitrile) was dissolved. Thus, a polymerizable monomer composition was prepared.

The polymerizable monomer composition obtained was introduced into the above dispersion medium, followed by stirring at 10,000 rpm for 10 minutes at 60° C. using a TK-type homomixer under nitrogen atmosphere, to carry out granulation of the polymerizable monomer composition. Thereafter, while stirring with paddle stirring blades, the temperature was raised to 80° C., and the reaction was carried out for 10 hours. After the polymerization reaction was completed, the residual monomers were evaporated under reduced pressure, the reaction product was cooled, and thereafter hydrochloric acid was added to dissolve the calcium phosphate, followed by filtration, washing with water and drying to obtain cyan color toner particles formed by suspension polymerization, having a weight average particle diameter of about 7.5 μm in a sharp particle size distribution.

Based on 100 parts of the cyan toner particles thus obtained, 0.7 part of hydrophobic fine silica powder having a BET specific surface area of 200 $m^2/g$ as measured was externally added to obtain a non-magnetic cyan toner A. Physical properties of the cyan toner A thus obtained were as shown in Table 1. Five parts of this cyan toner A was blended with 95 parts of a magnetic ferrite carrier (average particle diameter: 40 μm) coated with an acrylic resin, to obtain two component developer A.

| Polymerization Toner, Production Example B | |
|---|---|
| Styrene (monomer) | 165 parts |
| n-Butyl acrylate (monomer) | 35 parts |
| C.I. Pigment Blue 15:3 (colorant) | 15 parts |
| Dialkylsalicylic acid metal compound (negative charge control agent) | 3 parts |
| Saturated polyester (polar resin; acid value: 14; peak molecular weight: 8,000) | 10 parts |

The above materials were heated to 60° C., and uniformly dissolved and dispersed using a TK-type homomixer at 12,000 rpm. In the mixture obtained, 10 parts of a polymerization initiator 2,2'-azobis(2,4-dimethylvaleronitrile) was dissolved. Thus, a polymerizable monomer composition was prepared.

The polymerizable monomer composition obtained was introduced into the same dispersion medium as used in Production Example A, followed by stirring at 10,000 rpm for 10 minutes at 60° C. in an atmosphere of nitrogen using a TK-type homomixer, to carry out granulation of the polymerizable monomer composition. Thereafter, while stirring with paddle stirring blades, the temperature was raised to 80° C., and the reaction was carried out for 10 hours. After the polymerization reaction was completed, the residual monomers were evaporated under reduced pressure as in Production Example A, the reaction product was cooled, and thereafter hydrochloric acid was added to dissolve the calcium phosphate, followed by filtration, washing with water and drying to obtain cyan color toner particles having a weight average particle diameter of about 7.9 μm in a sharp particle size distribution.

Based on 100 parts of the cyan color toner particles thus obtained, 0.7 part of hydrophobic fine silica powder having a BET specific surface area of 200 $m^2/g$ was externally added to obtain a non-magnetic cyan toner B. Physical properties of the cyan toner B thus obtained were as shown in Table 1. Five parts of this cyan toner B was blended with 95 parts of a magnetic ferrite carrier (average particle diameter: 40 μm) coated with an acrylic resin, to obtain two component developer B.

| Polymerization Toner, Production Example C | |
|---|---|
| Styrene (monomer) | 165 parts |
| n-Butyl acrylate (monomer) | 35 parts |
| Carbon black (colorant) | 15 parts |
| Dialkylsalicylic acid metal compound (negative charge control agent) | 5 parts |
| Saturated polyester (polar resin; acid value: 14; peak molecular weight: 8,000) | 10 parts |
| Paraffin wax (release agent; melting point: 60° C.) | 30 parts |

The above materials were heated to 60° C., and uniformly dissolved and dispersed at 12,000 rpm using a TK-type homomixer. In the mixture obtained, 10 parts of a polymerization initiator 2,2'-azobis(2,4-dimethylvaleronitrile) was dissolved. Thus, a polymerizable monomer composition was prepared.

The polymerizable monomer composition obtained was introduced into the same dispersion medium as used in Production Example A, followed by stirring at 10,000 rpm for 20 minutes at 60° C. in an atmosphere of nitrogen using a TK-type homomixer, to carry out granulation of the polymerizable monomer composition. Thereafter, while stirring with paddle stirring blades, the temperature was raised to 80° C., and the reaction was carried out for 10 hours. After the polymerization reaction was completed, the residual monomers were evaporated under reduced pressure as in Production Example A, the reaction product was cooled, and thereafter hydrochloric acid was added to dissolve the calcium phosphate, followed by filtration, washing with water and drying to obtain black toner particles having a weight average particle diameter of about 7.2 μm in a sharp particle size distribution.

Based on 100 parts of the black toner particles thus obtained, 0.7 part of hydrophobic fine silica powder having a BET specific surface area of 200 $m^2/g$ was externally added to obtain a non-magnetic black toner C. Physical properties of the black toner B thus obtained are shown in Table 1. Five parts of this black toner C was blended with 95 parts of a magnetic ferrite carrier (average particle diameter: 40 μm) coated with an acrylic resin, to obtain two component developer C.

| Polymerization Toner, Production Example D (Comparative Example) | |
|---|---|
| Styrene (monomer) | 165 parts |
| n-Butyl acrylate (monomer) | 35 parts |
| Carbon black (colorant) | 15 parts |
| Dialkylsalicylic acid metal compound (negative charge control agent) | 3 parts |
| Saturated polyester (polar resin; acid value: 14; peak molecular weight: 8,000) | 10 parts |

The above materials were heated to 60° C., and uniformly dissolved and dispersed at 12,000 rpm using a TK-type homomixer. In the mixture obtained, 10 parts of a polymerization initiator 2,2'-azobis(2,4-dimethylvaleronitrile) was dissolved. Thus, a polymerizable monomer composition was prepared.

The polymerizable monomer composition obtained was introduced into the same dispersion medium as used in Production Example A, followed by stirring at 10,000 rpm for 10 minutes at 60° C. in an atmosphere of nitrogen using a TK-type homomixer, to carry out granulation of the polymerizable monomer composition. Thereafter, while stirring with paddle stirring blades, the temperature was raised to 60° C., and the reaction was carried out for 6 hours. After the polymerization reaction was completed, the reaction product was cooled, and thereafter hydrochloric acid was added to dissolve the calcium phosphate, followed by filtration, washing with water and drying to obtain black toner particles having a weight average particle diameter of about 7.4 μm in a sharp particle size distribution.

Based on 100 parts of the black toner particles thus obtained, 0.7 part of hydrophobic fine silica powder having a BET specific surface area of 200 $m^2/g$ was externally added to obtain a non-magnetic black toner D. Physical properties of the black toner B thus obtained are as shown in Table 1. Five parts of this black toner D was blended with 95 parts of a magnetic ferrite carrier (average particle diameter: 40 μm) coated with an acrylic resin, to obtain two component developer D.

Pulverization Toner, Produciton Example E

Into a four-necked flask, 180 parts of water purged with nitrogen and 20 parts of an aqueous solution of 0.2% by weight of polyvinyl alcohol were introduced, and then 77 parts of styrene, 22 parts of n-butyl acrylate, 1.4 parts of benzoyl peroxide and 0.2 part of divinylbenzene were added, followed by stirring to form a suspension. Thereafter, the inside of the flask was purged with nitrogen and then temperature was raised to 80° C. While maintaining this temperature for 10 hours, polymerization reaction was carried out to obtain a cross-linked styrene-n-butyl acrylate copolymer.

The copolymer was washed with water, and thereafter dried under reduced pressure while maintaining the temperature at 65° C.

Then, 88 parts of the resulting cross-linked styrene-n-butyl acrylate copolymer, 2 parts of a metal-containing azo dye, 7 parts of carbon black and 3 parts of low-molecular weight polypropylene were mixed using a fixed-chamber dry-mixing machine. While sucking at its vent port using a suction pump, the mixture obtained was melt-kneaded by means of a twin-screw extruder.

The resulting melt-kneaded product was crushed using a hammer mill to obtain a 1 mm mesh-pass crushed product. This crushed product was further pulverized using a mechanical pulverizer until it had a volume average particle diameter of from 20 to 30 μm, and thereafter finely pulverized by means of a jet mill utilizing impact between particles in a cyclonic stream. Subsequently, in a surface-modifying machine, toner particles were made spherical by the action of thermal and mechanical shear force, followed by classification by means of a multi-division classifier utilizing the Coanda effect, to obtain black toner particles with a weight average particle diameter of 7.9 μm.

To 98.6 parts of the black toner particles thus obtained, 1.4 parts of hydrophobic fine silica powder was added and mixed to obtain a non-magnetic black toner E. Physical properties of the black toner E thus obtained were as shown in Table 1. Five parts of this black toner E was blended with 95 parts of a magnetic ferrite carrier (average particle diameter: 40 μm coated with an acrylic resin, to obtain two component developer E.

The shape factors of the black toner E were measured to find that SF-1 was 109 and SF-2 was 109. The residual monomers were in a quantity of 250 ppm.

Pulverization Toner, Production Example F

Into a four-necked flask, 180 parts of water purged with nitrogen and 20 parts of an aqueous solution of 0.2% by weight of polyvinyl alcohol were introduced, and then 77 parts of styrene, 22 parts of n-butyl acrylate, 1.5 parts of benzoyl peroxide and 0.3 part of divinylbenzene were added, followed by stirring to form a suspension. Thereafter, the inside of the flask was purged with nitrogen and then temperature was raised to 80° C. While maintaining this temperature for 10 hours, polymerization reaction was carried out to obtain a cross-linked styrene-n-butyl acrylate copolymer.

The copolymer was washed with water, and thereafter dried under reduced pressure while maintaining the temperature at 65° C.

Then, 88 parts of the resulting cross-linked styrene-n-butyl acrylate copolymer, 2 parts of a metal-containing azo dye, 7 parts of carbon black and 3 parts of low-molecular weight polypropylene were mixed using a fixed-chamber dry-mixing machine. While sucking at its vent port using a suction pump, the mixture obtained was melt-kneaded by means of a twin-screw extruder.

The resulting melt-kneaded product was crushed using a hammer mill to obtain a 1 mm mesh-pass crushed product. This crushed product was further pulverized using a mechanical pulverizer until it had a volume average particle diameter of from 20 to 30 μm, and thereafter finely pulverized by means of a jet mill utilizing impact between particles in a cyclonic stream, followed by classification using a multi-division classifier utilizing the Coanda effect, to obtain black toner particles with a weight average particle diameter of 7.0 μm.

To 98.6 parts of the black toner particles thus obtained, 1.4 parts of hydrophobic fine silica powder was added and mixed to obtain a non-magnetic black toner F. Physical properties of the black toner F thus obtained were as shown in Table 1. Five parts of this black toner F was blended with 95 parts of a magnetic ferrite carrier (average particle diameter: 40 μm) coated with an acrylic resin, to obtain two component developer F.

The shape factors of the black toner F were measured to find that SF-1 was 138 and SF-2 was 117. The residual monomers were in a quantity of 790 ppm.

Pulverization Toner, Production Example G (Comparative Example)

Into a four-necked flask, 180 parts of water purged with nitrogen and 20 parts of an aqueous solution of 0.2% by weight of polyvinyl alcohol were introduced, and then 77 parts of styrene, 22 parts of n-butyl acrylate, 1.2 parts of benzoyl peroxide and 0.2 part of divinylbenzene were added, followed by stirring to form a suspension. Thereafter, the inside of the flask was purged with nitrogen and then temperature was raised to 80° C. While maintaining this temperature for 10 hours, polymerization reaction was carried out to obtain a cross-linked styrene-n-butyl acrylate copolymer. The copolymer was washed with water, and thereafter dried at 45° C. under normal pressure.

Then, 88 parts of the resulting cross-linked styrene-n-butyl acrylate copolymer, 2 parts of a metal-containing azo dye, 7 parts of carbon black and 3 parts of low-molecular weight polypropylene were mixed using a fixed-chamber dry-mixing machine, and the mixture obtained was melt-kneaded using a twin-screw extruder.

The resulting melt-kneaded product was crushed using a hammer mill to obtain a 1 mm mesh-pass crushed product. This crushed product was further pulverized using a mechanical pulverizer until it had a volume average particle diameter of from 20 to 30 μm, and thereafter finely pulverized by means of an air pulverizer having an impact plate. Subsequently, in a surface-modifying machine, toner particles were made spherical by the action of thermal and mechanical shear force, followed by classification by means of a multi-division classifier utilizing the Coanda effect, to obtain black toner particles with a weight average particle diameter of 6.8 μm.

To 98.6 parts of the black toner particles thus obtained, 1.5 parts of hydrophobic fine silica powder was added and mixed to obtain a non-magnetic black toner G. Physical properties of the black toner G thus obtained were as shown in Table 1. Five parts of this black toner G was blended with 95 parts of a magnetic ferrite carrier (average particle diameter: 40 μm) coated with an acrylic resin, to obtain two component developer G.

The shape factors of the black toner G were measured to find that SF-1 was 125 and SF-2 was 113. The residual monomer concentration was 1,300 ppm.

Pulverization Toner, Production Example H (Comparative Example)

Into a four-necked flask, 180 parts of water purged with nitrogen and 20 parts of an aqueous solution of 0.2% by weight of polyvinyl alcohol were introduced, and then 77 parts of styrene, 22 parts of n-butyl acrylate, 1.5 parts of benzoyl peroxide and 0.3 part of divinylbenzene were added, followed by stirring to form a suspension. Thereafter, the inside of the flask was purged with nitrogen and then temperature was raised to 80° C. While maintaining this temperature for 6 hours, polymerization reaction was carried out to obtain a cross-linked styrene-n-butyl acrylate copolymer.

The copolymer was washed with water, and thereafter dried at 45° C. under normal pressure.

Then, 88 parts of the resulting cross-linked styrene-n-butyl acrylate copolymer, 2 parts of a metal-containing azo dye, 7 parts of carbon black and 3 parts of low-molecular weight polypropylene were mixed using a fixed-chamber dry-mixing machine, and the mixture obtained was melt-kneaded by means of a twin-screw extruder.

The resulting melt-kneaded product was crushed using a hammer mill to obtain a 1 mm mesh-pass crushed product. This crushed product was further finely pulverized using an air pulverizer having an impact plate. The finely pulverized product was classified by means of a multi-division classifier utilizing the Coanda effect, to obtain black toner particles with a weight average particle diameter of 7.5 μm.

To 98.6 parts of the black toner particles thus obtained, 1.4 parts of hydrophobic fine silica powder was added and mixed to obtain a non-magnetic black toner H. Physical properties of the black toner H thus obtained were as shown in Table 1.

The shape factors of the black toner H were measured to find that SF-1 was 161 and SF-2 was 145. The residual monomer concentration was 1,700 ppm.

Photosensitive Member Production Example A

First, 10 parts of conductive titanium oxide (coated with tin oxide; average primary particle diameter: 0.4 μm), 10 parts of a phenol resin precursor (resol type), 10 parts of methanol and 10 parts of butanol were dispersed using a sand mill. In the dispersion obtained, an aluminum cylinder of 80 mm in external diameter and 360 mm in length was dipped for coating, followed by curing at 140° C. to provide on the aluminum cylinder (a substrate) a conductive layer having a volume resistivity of $5\times10^{9}$ Ω·cm and a thickness of 20 μm.

Next, 10 parts of methoxymethylated nylon (degree of methoxymethylation: about 30%) shown below:

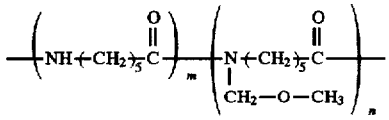

(wherein m and n each represent an integer) and 150 parts of isopropanol were mixed and dissolved, into which the above aluminum cylinder was dipped to carry out coating to provide on the conductive layer a subbing layer of 1 μm thick.

Next, 10 parts of an azo pigment shown below:

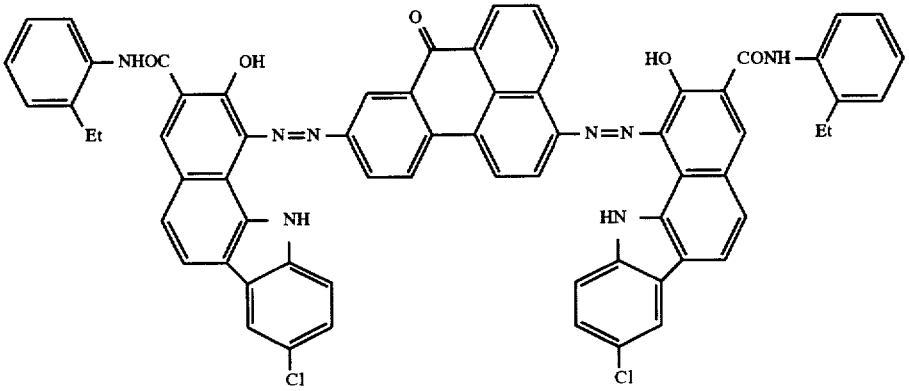

5 parts of a polycarbonate resin (bisphenol-A; molecular weight: 30,000) shown below:

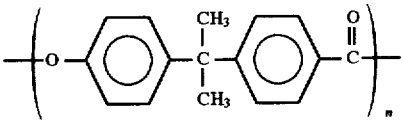

(wherein n represents an integer) and 700 parts of cyclohexanone were dispersed using a sand mill. In the dispersion obtained, the above aluminum cylinder was dipped to form a charge generation layer 0.05 μm thick on the subbing layer.

Next, 10 parts of a triphenylamine shown below:

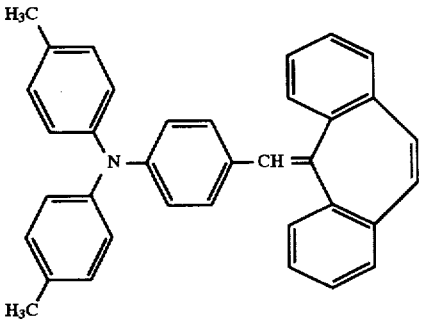

10 parts of a polycarbonate resin (bisphenol-Z type; molecular weight: 20,000) having following structure:

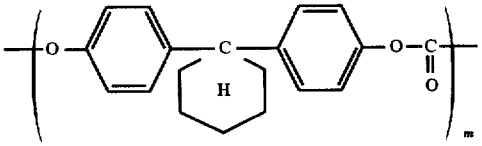

(wherein m represents an integer), 50 parts of monochlorobenzene, and 15 parts of dichloromethane were mixed with stirring. Thereafter, in the mixture solution obtained, the above aluminum cylinder was dipped and then dried with hot air to provide on the charge generation layer a charge transport layer 20 μm thick.

Next, 1 part of fine carbon fluoride powder (average particle diameter: 0.23 μm; available from Central Glass Co., Ltd.), 6 parts of a polycarbonate resin (bisphenol-Z type; molecular weight: 80,000) having the structure shown below:

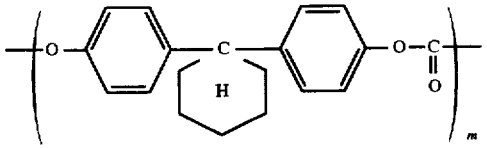

(wherein m represents an integer), (wherein m represents an integer), 0.1 part of a perfluoroalkyl acrylate-methyl methacrylate block copolymer (molecular weight: 30,000) shown below:

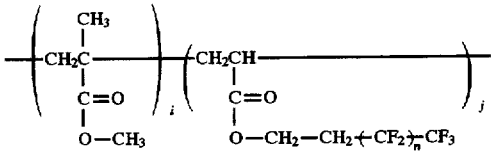

(wherein i and j each represent an integer, and n is 4 to 16), 120 parts of monochlorobenzene, and 80 parts of dichloromethane were dispersed and mixed using a sand mill. To the dispersion obtained, 3 parts of a triphenylamine shown below:

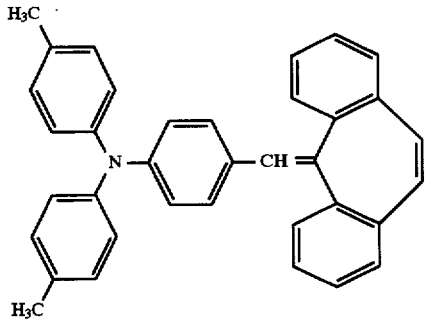

was added and mixed to dissolve, and the solution obtained was applied on the charge transport layer of the aluminum cylinder by spray coating to provide a protective layer 5 μm thick. Thus, photosensitive member A was produced.

The surface of the photosensitive member A was pealed off, and then the elements present in the surface of the photosensitive member was qualitatively and qualitatively analyzed using an X-ray photoelectron spectroscope ESCALAB Model 200-X, manufactured by VG Co., using MgKα(300 W) as an X-ray source. Measurement was made in the region of 2 mm×3 mm in a depth of several angstroms. The surface of the photosensitive member A contained 5.2% of fluorine (F) atoms and 81.3% of carbon (C) atoms, where the F/C ratio was 0.064. The contact angle with water of the surface of the photosensitive member A was 100°.

Photosensitive Member Production Example B

The procedure in Production Example A was repeated to provide on the aluminum cylinder the conductive layer, the subbing layer and the charge generation layer.

Next, 3 parts of a triphenylamine shown below:

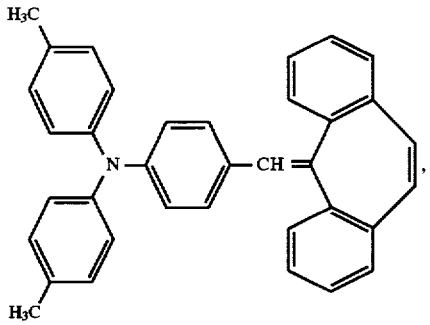

7 parts of a triphenylamine shown below:

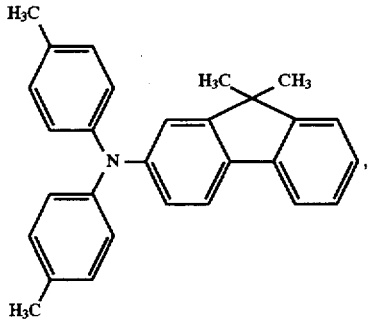

10 parts of a polycarbonate resin (bisphenol-Z type; molecular weight: 20,000) having the structure shown below:

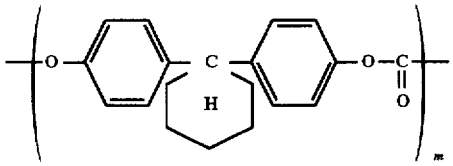

(wherein m represents an integer), 50 parts of monochlorobenzene, and 15 parts of dichloromethane were mixed with stirring. Thereafter, in the solution obtained, the above aluminum cylinder was dipped and then dried with hot air to provide on the charge generation layer a charge transport layer of 20 μm thickness.

Next, 3 parts of fine carbon fluoride powder (average particle diameter: 0.27 μm; available from Central Glass Co., Ltd.), 5 parts of a polycarbonate resin (bisphenol-Z; molecular weight: 80,000) having the structure shown below:

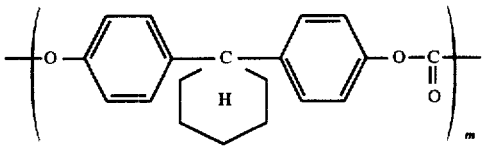

(wherein m represents an integer), 0.3 part of a fluorine-substituted graft polymer (F content: 27% by weight; molecular weight: 25,000) shown below:

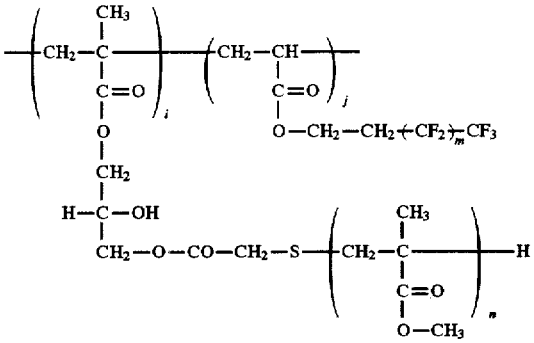

(wherein i, j, m and n each represent an integer), 120 parts of monochlorobenzene, and 80 parts of dichloromethane were dispersed and mixed using a sand mill. To the dispersion obtained, 2.5 parts of triphenylamine shown below:

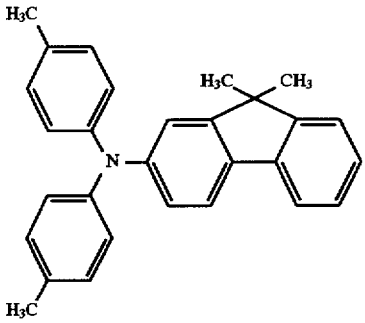

was added and mixed to dissolve, and the solution obtained was applied on the charge transport layer of the aluminum cylinder by spray coating to provide a protective layer of 4 μm thickness. Thus, photosensitive member B was produced.

The surface of this photosensitive member B contained 11.3% of fluorine (F) atoms and 75.5% of carbon (C) atoms, where the F/C ratio was 0.150. The contact angle with water of the surface of the photosensitive member B was 110°.

Photosensitive Member Production Example C

The procedure in Production Example A was repeated to produce photosensitive member C, except that the protective layer was replaced with the one as formulated below.

One part of spherical three-dimensionally cross-linked fine polysiloxane particles (average particle diameter: 0.29 μm; available from Toshiba Silicone Co., Ltd.), 6 parts of a polycarbonate resin (bisphenol-Z; molecular weight: 80,000) having the structure shown below:

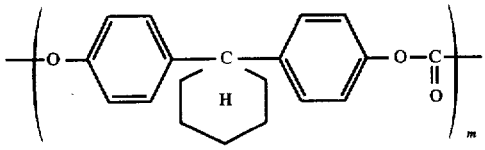

(wherein m represents an integer), 0.1 part of a polydimethylsiloxane methacrylate-methyl methacrylate block copolymer (molecular weight: 50,000; Si content: 12% by weight) shown below:

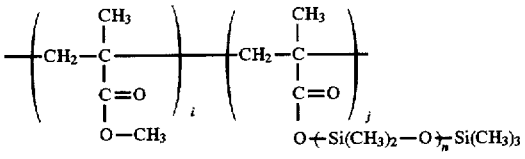

(wherein i and j each represent an integer, and n is 1 to 15). 120 parts of monochlorobenzene, and 80 parts of dichloromethane were dispersed and mixed using a sand mill. To the dispersion obtained, 3 parts of a triphenylamine shown next page:

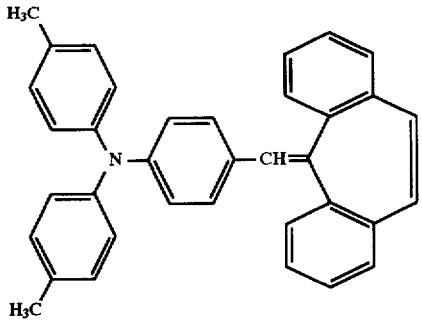

was added and mixed to dissolve, and the solution obtained was applied on the charge transport layer of the aluminum cylinder by spray coating to provide a protective layer of 3 μm thickness. Thus, the photosensitive member C was produced.

The surface of this photosensitive member C contained 10.2% of silicon (Si) atoms and 69.3% of carbon (C) atoms, where the Si/C ratio was 0.147. The contact angle with water of the surface of the photosensitive member C was 105°.

Photosensitive Member Production Example D (Comparative Example)

The procedure in Production Example A was repeated to produce photosensitive member D, except that no protective layer was provided.

From the surface of this photosensitive member D, the fluorine (F) atoms and/or the silicon (Si) atoms were not detected and hence both the F/C ratio and the Si/C ratio were 0. The contact angle with water of the surface of the photosensitive member D was 79°.

EXAMPLES 1 TO 5 & COMPARATIVE EXAMPLES 1 TO 4

A digital copying machine was modified as shown in FIGS. 3 and 4 where a developing assembly for magnetic brush development was set and the cleaner was removed, and the photosensitive drum was changed to the stated photosensitive member as shown in Table 1 (a modified copying machine GP-55, manufactured by Canon Inc.). The two component developers respectively containing the toners shown in Table 1 were each applied, and images were reproduced to make tests while successively supplying the toner.

The development potential was so set as to enable the cleaning of the residual toner and the development simultaneously, and continuous 5,000 sheet copying tests were made. In the above modified machine, corona charging assemblies were used as the photosensitive member charging means and the transfer means, a semiconductor laser was used as the imagewise exposure means to expose image areas, and the electrostatic latent images were developed by reverse development. The process speed was so set that images were reproduced on 30 sheets of A4 paper fed widthwise per minute.

Results obtained are shown in Table 2. Evaluation was made in the following way.

Fog quantity was measured using a reflection densitometer, REFLECTOMETER MODEL TC-6DS (manufactured by Tokyo Denshoku Co., Ltd.). The worst value of reflection density at white ground areas of paper after printing was represented by Ds, and an average value of reflection densities on the paper before printing as Dr, where a value of Ds–Dr was regarded as fog quantity. Images with a fog quantity of 2% or less are substantially fog-free good images, and those with a fog quantity of more than 5% are images with conspicuous fog. In Table 2, the values on images at the initial stage and after 5,000 sheet running are shown.

Image density is indicated with numerical values obtained by measuring solid black square images of 5×5 mm square and solid black circle images of 5 mm diameter using a Macbeth densitometer (manufactured by Macbeth Co.). In Table 2, the values on images at the initial stage and after 5,000 sheet running are shown.

Resolution was evaluated in the following way: An original image is consisting of 12 patterns each composed of five fine lines having equal line width and equal interval and there are 2.8, 3.2, 3.6, 4.0, 4.5, 5.0, 5.6, 6.3, 7.1, 8.0, 9.0 and 10.0 lines in 1 mm respectively. The original image is copied under proper copying conditions to obtain images, which are then observed with a magnifier, and the number of lines (lines/mm) in images where the fine lines are clearly seen separate is regarded as a value of resolution. In Table 2, the values after 5,000 sheet copying are shown.

With regard to faulty images, whether or not white spots occur on solid black areas and granular spots appear on solid white areas was examined for evaluation.

TABLE 1

Physical Properties of Toner and Photosensitive Member

| | Toner | | | | | | | | Photosensitive member | | | |
|---|---|---|---|---|---|---|---|---|---|---|---|---|
| | | Residual monomer quantity | Shape factor | | Toner production process | Core/shell structure | External additive coverage (%) | Average particle diameter (μm) | | Contact angle | Surface elements | |
| | Type | (ppm) | SF-1 | SF-2 | | | | | Type | θ | F/C | Si/C |
| Example: | | | | | | | | | | | | |
| 1 | A | 100 | 110 | 105 | Polymerization | Yes | 40 | 7.5 | B | 110 | 0.150 | 0 |
| 2 | B | 280 | 109 | 106 | Polymerization | No | 30 | 7.9 | A | 100 | 0.064 | 0 |
| 3 | C | 150 | 108 | 103 | Polymerization | Yes | 50 | 7.2 | C | 105 | 0 | 0.147 |
| 4 | E | 250 | 109 | 109 | Pulverization | No | 30 | 7.9 | B | 110 | 0.150 | 0 |
| 5 | F | 790 | 138 | 117 | Pulverization | No | 20 | 7.0 | C | 105 | 0 | 0.147 |
| Comparative Example: | | | | | | | | | | | | |
| 1 | D | 1,500 | 112 | 108 | Polymerization | No | 40 | 7.4 | B | 110 | 0.150 | 0 |
| 2 | G | 1,300 | 125 | 113 | Pulverization | No | 40 | 6.8 | D | 79 | 0 | 0 |
| 3 | H | 1,700 | 161 | 145 | Pulverization | No | 30 | 7.5 | D | 79 | 0 | 0 |
| 4 | A | 100 | 110 | 105 | Polymerization | Yes | 40 | 7.5 | D | 79 | 0 | 0 |

TABLE 2

Results of Evaluation

| | Filming | Image density | Fog | Resolution, vertical/horizontal | Faulty images during copying test |
|---|---|---|---|---|---|
| Example: | | | | | |
| 1 | 5,000 sheets OK | 1.50/1.50 | 0.9/1.1 | 9.0/8.0 | Not occur until 5,000th sh. |
| 2 | 5,000 sheets OK | 1.48/1.46 | 1.0/1.4 | 9.0/8.0 | Not occur until 4,500th sh. |
| 3 | 5,000 sheets OK | 1.50/1.50 | 1.0/1.1 | 9.0/8.0 | Not occur until 5,000th sh. |
| 4 | 5,000 sheets OK | 1.49/1.47 | 1.0/1.6 | 9.0/8.0 | Not occur until 4,500th sh. |
| 5 | 5,000 sheets OK | 1.49/1.41 | 1.0/2.1 | 8.0/6.3 | Not occur until 4,500th sh. |
| Comparative Example: | | | | | |
| 1 | 3,000 sheets Occur | 1.50/1.30 | 1.2/6.9 | 4.0/2.0 | Occur before 3,000th sh. |
| 2 | 2,000 sheets Occur | 1.45/1.20 | 1.9/7.5 | 4.0/3.6 | Occur before 2,000th sh. |
| 3 | 2,000 sheets Occur | 1.41/1.09 | 1.8/7.9 | 3.6/2.0 | Occur before 2,000th sh. |
| 4 | 5,000 sheets OK | 1.49/1.45 | 1.0/1.5 | 9.0/8.0 | Occur before 4,000th sh. |

In each Example, toner consumption decreased by 5 to 10% by weight as compared with copying machines having the cleaner that performs cleaning by means of a cleaning blade, resulting in an increase in copy volume per unit weight of the toner.

Photosensitive Member Production Example 1

Figure 6:
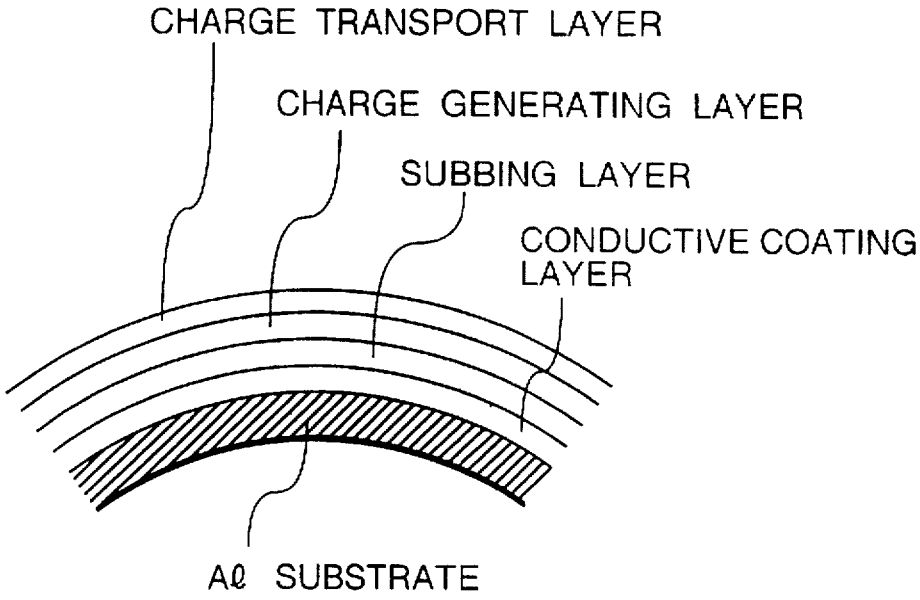
FIG. 6 illustrates a cross-section of an example of the layer structure of a photosensitive member.
Figure 7:
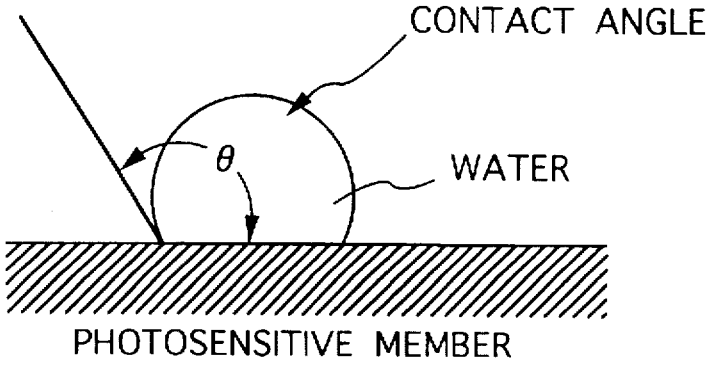
FIG. 7 is to explain the contact angle of the surface of a photosensitive member with water.

To produce a photosensitive member, an aluminum cylinder of 30 mm diameter and 254 mm long was used as a substrate. On this substrate, layers with configuration as shown in FIG. 6 were successively formed layer-by-layer by dip coating. Thus, photosensitive member No. 1 was produced.

(1) Conductive coating layer: Mainly composed of powders of tin oxide and titanium oxide dispersed in phenol resin. Layer thickness: 15 μm.

(2) Subbing layer: Mainly composed of a modified nylon and a copolymer nylon. Layer thickness: 0.6 μm.

(3) Charge generation layer: Mainly composed of a titanyl phthalocyanine pigment having absorption in a long wavelength range, dispersed in butyral resin. Layer thickness: 0.7 μm.

(4) Charge transport layer: Mainly composed of a hole-transporting triphenylamine compound dissolved in a polycarbonate resin (molecular weight: 20,000 as measured by Ostwald viscometry) in a weight ratio of 9:10, and in which polytetrafluoroethylene powder (average particle diameter: 0.2 μm) was further added in an amount of 5% by weight based on the total solid content and uniformly dispersed. Layer thickness: 21 μm.

The contact angle with water of the surface of the photosensitive member No. 1 was 94°.

The contact angle was measured by using pure water and as a device a contact angle meter Model CA-DS, manufactured by Kyowa Kaimen Kagaku K.K. An illustration concerning the contact angle θ is given in FIG. 6.

Photosensitive Member Production Example 2

A photosensitive member was produced in the same manner as the photosensitive member No. 1 up to the formation of the subbing layer.

(3) Charge generation layer: Mainly composed of a phthalocyanine pigment having absorption in a long wavelength range, dispersed in butyral resin. Layer thickness: 0.5 μm.

(4) Charge transport layer: Mainly composed of a hole-transporting triphenylamine compound dissolved in a polycarbonate resin (molecular weight: 20,000 as measured by Ostwald viscometry) in a weight ratio of 8:10, and in which polytetrafluoroethylene powder (average particle diameter: 0.2 μm) was further added in an amount of 5% by weight based on the total solid content and uniformly dispersed. Layer thickness: 22 μm.

The contact angle with water of the surface of the photosensitive member No. 2 was 94°.

Photosensitive Member Production Example 3 (Comparative Example)

A photosensitive member was produced in the same manner as the photosensitive member No. 1 up to the formation of the subbing layer.

(3) Charge generation layer: Mainly composed of an azo pigment having absorption in a long wavelength range, dispersed in butyral resin. Layer thickness: 0.6 μm.

(4) Charge transport layer: Mainly composed of a hole-transporting triphenylamine compound dissolved in a polycarbonate resin in a weight ratio of 8:10. Layer thickness: 25 μm.

The contact angle with water of the surface of the photosensitive member No. 3 was 73°.

Photosensitive Member Production Example 4

A photosensitive drum No. 4 was produced in the same manner as the photosensitive member No. 1 up to the formation of the charge generation layer. The charge transport layer was formed using a solution prepared by dissolving a hole-transporting triphenylamine compound in a polycarbonate resin in a weight ratio of 10:10, and by applying the solution in a layer thickness of 18 μm. To further form a protective layer thereon, a composition prepared by dissolving the like materials in a weight ratio of 4:10 and in which polytetrafluoroethylene powder was added in an amount of 15% by weight based on the total solid content and uniformly dispersed, was applied onto the charge transport layer by spray coating so as to be in a layer thickness of 3 μm.

The contact angle with water of the surface of the photosensitive member No. 4 was 100°.

Photosensitive characteristics of the respective photosensitive members were measured using as an electrophotographic apparatus a modified machine of a laser beam printer (LBP-860, manufactured by Canon Inc., modified to operate at 1.5 times the process speed). The process speed is 70 mm/s. Digital latent images were formed at 300 dpi in a binary mode. In the present Examples, a DC voltage was applied to the charging roller to electrostatically charge the photosensitive members.

The characteristics of the photosensitive members were measured while changing the amount of laser light (about 780 nm) to monitor the potential. Here, laser exposure was applied over the whole surface under continuous irradiation in the secondary scanning direction.

Results obtained are shown in Table 3.

TABLE 3

| | Photosensitive member | | | |
|---|---|---|---|---|
| | No. 1 | No. 2 | No. 3 | No. 4 |
| Dark portion potential: (Vd) | −700 V | −700 v | −700 V | −700 V |
| Residual potential: (Vr) | −60 V | −55 V | −15 V | −60 V |
| (Vd + Vr)/2: | −380 V | −378 V | −358 V | −380 V |
| Slope between Vd and (Vd + Vr)/2: | 2,900 V $m^2$/cJ | 920 V $m^2$/cJ | 570 V $m^2$/cJ | 3,200 V $m^2$/cJ |
| 1/20 Slope: | 145 V $m^2$/cJ | 46 V $m^2$/cJ | 29 V $m^2$/cJ | 160 V $m^2$/cJ |
| 1/20 Slope tangent to the characteristic curve: | 0.43 cJ/$m^2$ | 1.55 cJ/$m^2$ | 2.80 cJ/$m^2$ | 0.40 cJ/$m^2$ |
| Five times of half-reduction exposure intensity: | 0.60 cJ/$m^2$ | 1.89 cJ/$m^2$ | 3.05 cJ/$m^2$ | 0.60 cJ/$m^2$ |

*Comparative Example

Binder Resin Production Example 1

Into a four-necked flask, 180 parts of water purged with nitrogen and 20 parts of an aqueous solution of 0.2% by weight of polyvinyl alcohol were introduced, and then 77 parts of styrene, 22 parts of n-butyl acrylate, 1.9 parts of benzoyl peroxide and 0.2 part of divinylbenzene were added, followed by stirring to form a suspension. Thereafter, the inside of the flask was purged with nitrogen and then temperature was raised to 80° C. While maintaining this temperature for 12 hours, polymerization reaction was carried out to obtain a copolymer.

The copolymer was washed with water, and thereafter dried in an environment of reduced pressure while maintaining the temperature at 65° C. Thus, a binder resin, No. 1, of which residual monomer content was reduced was obtained.

Binder Resin Production Example 2

Into a four-necked flask, 180 parts of water purged with nitrogen and 20 parts of an aqueous solution of 0.2% by weight of polyvinyl alcohol were introduced, and then 77 parts of styrene, 22 parts of n-butyl acrylate, 1.8 parts of benzoyl peroxide and 0.1 part of divinylbenzene were added, followed by stirring to form a suspension. Thereafter, the inside of the flask was purged with nitrogen and then temperature was raised to 80° C. While maintaining this temperature for 10 hours, polymerization reaction was carried out to obtain a copolymer.

The copolymer was washed with water, and then dried at 45° C. under normal pressure to obtain a resin.

Then, 100 parts of the resin and 800 parts of toluene were introduced into a four-necked flask, and the temperature was raised to carry out reflux for 30 minutes. Thereafter, the residual monomers were removed while removing the organic solvent, and the resulting resin was cooled, followed by pulverization to obtain a binder resin, No. 2.

Binder Resin Production Example 3

Into a four-necked flask, 180 parts of water purged with nitrogen and 20 parts of an aqueous solution of 0.2% by weight of polyvinyl alcohol were introduced, and then 77 parts of styrene, 22 parts of n-butyl acrylate, 1.9 parts of benzoyl peroxide and 0.3 part of divinylbenzene were added, followed by stirring to form a suspension. Thereafter, the inside of the flask was purged with nitrogen and then temperature was raised to 80° C. While maintaining this temperature for 10 hours, polymerization reaction was carried out to obtain a copolymer.

The copolymer was washed with water, and then dried in an environment of reduced pressure to obtain a binder resin, No. 3.

Binder Resin Production Example 4

Into a four-necked flask, 180 parts of water purged with nitrogen and 20 parts of an aqueous solution of 0.2% by weight of polyvinyl alcohol were introduced, and then 77 parts of styrene, 22 parts of n-butyl acrylate, 1.2 parts of benzoyl peroxide and 0.2 part of divinylbenzene were added, followed by stirring to form a suspension. Thereafter, the inside of the flask was purged with nitrogen and then temperature was raised to 80° C. While maintaining this temperature for 6 hours, polymerization reaction was carried out to obtain a copolymer.

The copolymer was washed with water, and then dried at 45° C. under normal pressure to obtain a binder resin, No. 4.

Binder Resin Production Example 5

Into a four-necked flask, 180 parts of water purged with nitrogen and 20 parts of an aqueous solution of 0.2% by weight of polyvinyl alcohol were introduced, and then 77 parts of styrene, 22 parts of n-butyl acrylate, 1.5 parts of benzoyl peroxide and 0.3 part of divinylbenzene were added, followed by stirring to form a suspension. Thereafter, the inside of the flask was purged with nitrogen and then temperature was raised to 80° C. While maintaining this temperature for 6 hours, polymerization reaction was carried out to obtain a copolymer.

The copolymer was washed with water, and then dried at 45° C. under normal pressure to obtain a binder resin, No. 5.

Toner Production Example 1

First, 88% by weight of the binder resin No. 1, 2% by weight of a metal-containing azo dye, 7% by weight of carbon black and 3% by weight of low-molecular weight polypropylene were mixed using a fixed-chamber dry-mixing machine. While sucking at its vent port connected to a suction pump, the mixture obtained was melt-kneaded by means of a twin-screw extruder.

The resulting melt-kneaded product was crushed using a hammer mill to obtain a 1 mm mesh-pass crushed product. This crushed product was further pulverized using a mechanical pulverizer until it had a volume average particle diameter of-from 20 to 30 μm, and thereafter finely pulverized by means of a jet mill utilizing impact between particles in a cyclonic stream. Then, toner particles were surface-modified by the action of thermal and mechanical shear force, followed by classification by means of a multi-division classifier utilizing the Coanda effect, to obtain negatively chargeable non-magnetic toner particles with a weight average particle diameter of 7.9 μm.

Then, 98.6% by weight of the toner particles obtained was mixed with 1.4% by weight of hydrophobic fine silica powder to obtain a toner, No. 1.

The shape factors of the toner No. 1 were measured to find that SF-1 was 109 and SF-2 was 109. The residual monomers in the toner No. 1 were in a quantity of 90 ppm.

Toner Production Example 2

First, 88% by weight of the binder resin No. 2, 2% by weight of a metal-containing azo dye, 7% by weight of carbon black and 3% by weight of low-molecular weight polypropylene were mixed using a fixed-chamber dry-mixing machine. While sucking at its vent port connected to a suction pump, the mixture obtained was melt-kneaded by means of a twin-screw extruder.

The resulting melt-kneaded product was crushed using a hammer mill to obtain a 1 mm mesh-pass crushed product. This crushed product was further pulverized using a mechanical pulverizer until it had a volume average particle diameter of from 20 to 30 μm, and thereafter finely pulverized by means of a jet mill utilizing impact between particles in a cyclonic stream. Then, toner particles were surface-modified by the action of thermal and mechanical shear force, followed by classification by means of a multi-division classifier utilizing the Coanda effect, to obtain toner particles with a weight average particle diameter of 8.3 μm.

Then, 98.7% by weight of the toner particles obtained was mixed with 1.3% by weight of hydrophobic fine silica powder to obtain a toner, No. 2.

The shape factors of the toner No. 2 were measured to find that SF-1 was 115 and SF-2 was 111. The residual monomers in the toner No. 2 were in a quantity of 410 ppm.

Toner Production Example 3

First, 88% by weight of the binder resin No. 3, 2% by weight of a metal-containing azo dye, 7% by weight of carbon black and 3% by weight of low-molecular weight polypropylene were mixed using a fixed-chamber dry-mixing machine. While sucking at its vent port connected to a suction pump, the mixture obtained was melt-kneaded by means of a twin-screw extruder.

The resulting melt-kneaded product was crushed using a hammer mill to obtain a 1 mm mesh-pass crushed product. This crushed product was further pulverized using a mechanical pulverizer until it had a volume average particle diameter of from 20 to 30 μm, and thereafter finely pulverized by means of a jet mill utilizing impact between particles in a cyclonic stream. Then, toner particles were classified by means of a multi-division classifier utilizing the Coanda effect, to obtain toner particles with a weight average particle diameter of 7.0 μm.

Then, 98.6% by weight of the toner particles obtained was mixed with 1.4% by weight of hydrophobic fine silica powder to obtain a toner, No. 3.

The shape factors of the toner No. 3 were measured to find that SF-1 was 138 and SF-2 was 117. The residual monomers in the toner No. 3 were in a quantity of 790 ppm.

Toner Production Example 4 (Comparative Example)

First, 88% by weight of the binder resin No. 4, 2% by weight of a metal-containing azo dye, 7% by weight of carbon black and 3% by weight of low-molecular weight polypropylene were mixed using a fixed-chamber dry-mixing machine. The mixture obtained was melt-kneaded by means of a twin-screw extruder.

The resulting melt-kneaded product was crushed using a hammer mill to obtain a 1 mm mesh-pass crushed product. This crushed product was further pulverized using a mechanical pulverizer until it had a volume average particle diameter of from 20 to 30 μm, and thereafter finely pulverized by means of an air pulverizer having an impact plate. Subsequently, in a surface-modifying machine, toner particles were surface-modified by the action of thermal and mechanical shear force, followed by classification by means of a multi-division classifier to obtain toner particles with a weight average particle diameter of 6.8 μm.

Then, 98.5% by weight of the toner particles obtained was mixed with 1.5% by weight of hydrophobic fine silica powder to obtain a toner, No. 4.

The shape factors of the toner No. 4 were measured to find that SF-1 was 125 and SF-2 was 113. The residual monomers in the toner No. 4 were in a quantity of 1,300 ppm.

Toner Production Example 5 (Comparative Example)

First, 88% by weight of the binder resin No. 5, 2% by weight of a metal-containing azo dye, 7% by weight of carbon black and 3% by weight of low-molecular weight polypropylene were mixed using a fixed-chamber dry-mixing machine. The mixture obtained was melt-kneaded by means of a twin-screw extruder.

The resulting melt-kneaded product was crushed using a hammer mill to obtain a 1 mm mesh-pass crushed product. This crushed product was further finely pulverized by means of an air pulverizer having an impact plate. The finely pulverized product was classified by means of a multi-division classifier to obtain toner particles with a weight average particle diameter of 7.5 μm.

Then, 98.6% by weight of the toner particles obtained was mixed with 1.4% by weight of hydrophobic fine silica powder to obtain a toner, No. 5.

The shape factors of the toner No. 5 were measured to find that SF-1 was 161 and SF-2 was 144. The residual monomers in the toner No. 5 were in a quantity of 1,700 ppm.

Toner Production Example 6

First, 88% by weight of the binder resin No. 1, 2% by weight of a metal-containing azo dye, 7% by weight of carbon black and 3% by weight of low-molecular. weight polypropylene were mixed using a fixed-chamber dry-mixing machine. While sucking at its vent port connected to a suction pump, the mixture obtained was melt-kneaded by means of a twin-screw extruder.

The resulting melt-kneaded product was crushed using a hammer mill to obtain a 1 mm mesh-pass crushed product. This crushed product was further pulverized using a mechanical pulverizer until it had a volume average particle diameter of from 20 to 30 μm, and thereafter finely pulverized by means of an air pulverizer having an impact plate. Subsequently, in a surface-modifying machine, toner particles were surface-modified by the action of thermal and mechanical shear force, followed by classification by means of a multi-division classifier to obtain toner particles with a weight average particle diameter of 8.0 μm.

Then, 98.6% by weight of the toner particles obtained was mixed with 1.4% by weight of hydrophobic fine silica powder to obtain a toner, No. 6.

The shape factors of the toner No. 6 were measured to find that SF-1 was 135 and SF-2 was 118. The residual monomers in the toner No. 6 were in a quantity of 110 ppm.

Example 6

As an electrophotographic apparatus, a laser beam printer (trade name: LBP-860, manufactured by Canon Inc.) was modified to operate at a 1.5 times increased process speed, that is, 70 mm/sec. Digital latent images were formed at 300 dpi in a binary mode.

The cleaning rubber blade provided in the process cartridge for LBP-860 was removed, and also as shown in FIG. 2 a cleaning member 39 for the charging roller, comprised of non-woven fabric, was provided to the charging roller 31.

Then, the developing assembly 32 in the process cartridge was modified. A stainless steel sleeve was replaced with a medium-resistance rubber roller (diameter: 16 mm) made of a urethane foam, which was used as the developer carrying member 34 and was brought into touch with the photosensitive member 36. The developer carrying member was driven so as to rotate in the same direction as the photosensitive member and at a peripheral speed corresponding to 180% of the rotational peripheral speed of the photosensitive member, at the contact place between them.

As a means for coating the toner on the developer carrying member 34, a coating roller 35 was provided on the developer carrying member 34 and was brought into touch with this developer carrying member. In order to control the coat layer thickness of the toner on the developer carrying member, a blade 33 made of stainless steel, coated with a resin, was attached. The voltage applied at the time of development from the bias applying means 41 was made to have only a DC component (−300 V).

The residual toner once having positive polarity by means of the transfer roller 37 had been made to have negative polarity which was the same polarity as the charging polarity of the photosensitive member by charging roller 31. Thus by setting a development potential (−300 V) between charging potential and imagewise exposure potential of the photosensitive member, the negative-polarity residual toner present on the part of non-exposed area potential (photosensitive member charging potential) was collected to the developer carrying member 34.

The electrophotographic apparatus was modified and set under process conditions so as to be adaptable to the modification of the process cartridge. As to the transfer roller 37, it was set rotatable following the rotation of the photosensitive member 36.

In the modified apparatus, the photosensitive member 36 was uniformly charged by means of the roller charging assembly 31. Following the charging, image areas were exposed to laser light 40 to form an electrostatic latent image, which was then converted into a visible image (a toner image) by reverse development by the use of the toner, and thereafter the toner image was transferred to a transfer medium 38 by means of the transfer roller 37 to which a voltage was applied.

Using the photosensitive member No. 4, the toner No. 1 was used as the developer, and the photosensitive member was set to have a charging potential of −700 V as the dark potential.

In a running test, the photosensitive member was set to have an exposure intensity of 0.50 cJ/m$^2$, and a 8,000 sheet test was made in an environment of temperature 23° C. and relative humidity 55%.

At the initial stage, the 6,000th sheet and the 8,000th sheet, evaluation of image density, fog, ghost images, and blank areas in letter images was made in the following way.

At the initial stage, tone reproducibility and isolated-dot reproducibility were evaluated.

The image density is indicated as reflection density of 5×5 mm square images. Evaluation on the fog was made in the same manner as in Examples 1 to 5.

Image evaluation concerning the ghost was made using a pattern for outputting solid black strips corresponding to one round of the photosensitive member and thereafter outputting a halftone image formed of a one-dot horizontal line and two-dot blanks as shown by pattern 9 in FIG. 10.

As transfer mediums, plain paper of 75 g/m$^2$, cardboard of 130 g/m$^2$, postcard paper of 200 g/m$^2$, and films for overhead projectors were used.

As an evaluation method, a difference in reflection density of the area formed in the second round of the photosensitive member at places corresponding to the black image (black print areas) and blank image (non-image areas) in the first round, was measured using a Macbeth reflection densitometer when a print image is formed on one sheet, and calculated as shown below.

Difference in reflection density=reflection density (place with former image)−reflection density (place without image)

Results of the evaluation are shown in Table 4. The smaller the difference in reflection density is, the less the ghost occurs and the better its level stands.

To make overall evaluation on the ghost, ranks AAA, AA, A, B and C were set up. The ranks AAA, AA, A, B and C are respectively indicated according to the following criteria.

The sum of absolute values of differences in reflection densities on the respective transfer mediums was found, and ranges of the sum thereof were ranked in the following manner.

0.00: Rank AAA 0.01 to 0.02: Rank AA 0.03 to 0.04: Rank A 0.05 to 0.07: Rank B 0.08 or more: Rank C To evaluate gradation reproducibility, image densities of patterns 1 to 8 having different patterns as shown in Table 10 were measured.

In view of tone reproducibility, preferable density ranges of the respective patterns are as shown below, from the viewpoint of which the evaluation was made.

Pattern 1: 0.10 to 0.15 Pattern 2: 0.15 to 0.20
Pattern 3: 0.20 to 0.30 Pattern 4: 0.25 to 0.40
Pattern 5: 0.55 to 0.70 Pattern 6: 0.65 to 0.80
Pattern 7: 0.75 to 0.90 Pattern 8: 1.35 or more Estimation was made according to the following:

"Excellent" when all the patterns satisfy the densities within the above ranges; "Average" when one pattern is outside some range; and "Poor" when at least two patterns are outside some ranges.

The dot reproducibility concerning graphic images was evaluated by measuring the density of pattern 1 as a substitute. This is because developed areas will widen and densities will increase as the digital electrostatic latent image becomes indistinct. Judgement was made according to the following:

"Excellent" when the density was 0.10 to 0.15; "Average" when it was 0.16 to 0.17; and "Poor" when it was 0.18 or more.

The evaluation on the blank areas in letter images was made using a lattice pattern having 3-dot prints and 15-dot blanks. Postcard paper of 200 g/m$^2$ was used as the transfer medium.

An instance where only edges of lines remain and blank areas appear in white in middle areas of lines over the whole image is indicated as rank "C"; an instance where only edges of lines remain and blank areas appear in white in middle areas of lines at a part of the image, as rank "B"; and an instance where no blank areas appear in middle areas of lines over the whole image, as rank "A".

Results of the running test are shown in Table 4; details on the evaluation on ghost, in Table 5; and details on the evaluation of gradation, in Table 6.

After the running test was completed, the layer thickness of the protective layer was measured. As a result, it was 3 μm, which was on the level where no wear was detectable.

Example 7

Tests were made in the same manner as in Example 6 except that the toner No. 6 was used. As a result, blank areas a little occurred on the 8,000th sheet when postcard paper of 200 g/m$^2$ was used, but substantially good results were obtained.

Results of the running test are shown in Table 4; details on the evaluation on ghost, in Table 5; and details on the evaluation of gradation, in Table 6.

After the running test was completed, the layer thickness of the protective layer was measured. As a result, it was 3 μm, which was on the level where no wear was detectable.

Example 8

Tests were made in the same manner as in Example 6 except that the toner No. 2 and the photosensitive member No. 1 were used and the exposure intensity was changed to 0.55 cJ/m$^2$. As a result, a little poor results are seen on the fog compared with that in Example 6, but are on the level of no problem.

Results of the running test are shown in Table 4; details on the evaluation on ghost, in Table 5; and details on the evaluation of gradation, in Table 6.

After the running test was completed, the layer thickness of the charge transport layer was measured. As a result, it was 20 μm, showing a wear by 1 μm.

Example 9

Tests were made in the same manner as in Example 6 except that the toner No. 3 and the photosensitive member No. 1 were used and the exposure intensity was changed to 0.55 cJ/m$^2$. As a result, the fog was on a little poor level compared with that in Example 6 and blank areas a little occurred on the 8,000th sheet when postcard paper of 200 g/m$^2$ was used, but substantially the same results as in Example 6 were obtained.

After the running test was completed, the layer thickness of the charge transport layer was measured. As a result, it was 20 μm, showing a wear by 1 μm.

Example 10

Tests were made in the same manner as in Example 6 except that the toner No. 3 and the photosensitive member No. 2 were used and the exposure intensity was changed to 1.70 cJ/m$^2$. As a result, the ghost was on a little poor level compared with that in Example 6 and blank areas a little occurred on 8,000th sheet when postcard paper of 200 g/m$^2$ was used, but substantially the same results as in Example 6 were obtained.

After the running test was completed, the layer thickness of the charge transport layer was measured. As a result, it was 21 μm, showing a wear by 1 μm.

Comparative Example 5

Tests were made in the same manner as in Example 6 except that the toner No. 4 and the photosensitive member No. 3 were used and the exposure intensity was changed to 2.90 cJ/m$^2$. As a result, running performance was very poor in respect of the image density and the fog, and also the ghost was on a poor level.

The test on gradation and dot reproducibility was also made at an exposure intensity changed to 4.50 cJ/m$^2$ and the test on ghost was made at the 6,000th sheet and 8,000th sheet running. As a result, the increase in exposure intensity brought about an improvement in the evaluation on ghost, but resulted in poor images having no gradation and no dot reproducibility.

After the running test was completed, the layer thickness of the charge transport layer was measured. As a result, it was 22 μm, showing a wear of 3 μm.

Comparative Example 6

Tests were made in the same manner as in Example 6 except that the toner No. 5 was used, the photosensitive member No. 3 was used and the exposure intensity was changed to 2.90 cJ/m$^2$. As a result, running performance was very poor in respect of the image density and the fog, and also the ghost was on a poor level.

The test on gradation and dot reproducibility was also made at an exposure intensity changed to 2.40 cJ/m$^2$ and the test on ghost was made at 6,000th sheet and 8,000th sheet running. As a result, extremely poor results were not seen in respect of the gradation and dot reproducibility, but the ghost more seriously occurred to make images intolerable in use.

TABLE 4(A)

| | Photosensitive member | | | Toner | | | |
|---|---|---|---|---|---|---|---|
| | Type | Contact angle θ to water of the surface | Exposure intensity (during copying test) | Type | Shape factor SF-1 | Shape factor SF-2 | Residual monomer quantity (ppm) |
| Example: | | | | | | | |
| 6 | No. 4 | 100 degrees | 0.50 cJ/m$^2$ | No. 1 | 109 | 109 | 90 |
| 7 | No. 4 | 100 degrees | 0.50 cJ/m$^2$ | No. 6 | 135 | 118 | 110 |
| 8 | No. 1 | 94 degrees | 0.55 cJ/m$^2$ | No. 2 | 115 | 111 | 410 |
| 9 | No. 1 | 94 degrees | 0.55 cJ/m$^2$ | No. 3 | 138 | 117 | 790 |
| 10 | No. 2 | 94 degrees | 1.70 cJ/m$^2$ | No. 3 | 138 | 117 | 790 |
| Comparative Example: | | | | | | | |
| 5 | No. 3 | 73 degrees | 2.90 cJ/m$^2$ | No. 4 | 125 | 113 | 1,300 |
| 6 | No. 3 | 73 degrees | 2.90 cJ/m$^2$ | No. 5 | 161 | 144 | 1,700 |

TABLE 4(B)

| | Image density | | | Fog | | | Ghost | | | Blank areas | | |
|---|---|---|---|---|---|---|---|---|---|---|---|---|
| | Initial | 6,000 sheets | 8,000 sheets | Initial | 6,000 sheets | 8,000 sheets | Initial | 6,000 sheets | 8,000 sheets | Initial | 6,000 sheets | 8,000 sheets |
| Example: | | | | | | | | | | | | |
| 6 | 1.46 | 1.43 | 1.40 | 0.5 | 0.7 | 0.8 | AAA | AAA | AAA | A | A | A |
| 7 | 1.46 | 1.42 | 1.40 | 0.5 | 1.2 | 1.3 | AAA | AAA | AAA | A | A | B |
| 8 | 1.42 | 1.40 | 1.39 | 0.5 | 1.5 | 2.3 | AAA | AAA | AAA | A | A | A |
| 9 | 1.43 | 1.37 | 1.37 | 0.5 | 2.0 | 2.9 | AAA | AAA | AAA | A | A | B |
| 10 | 1.44 | 1.38 | 1.36 | 0.6 | 1.9 | 3.1 | AAA | AA | A | A | A | B |
| Comparative Example: | | | | | | | | | | | | |
| 5 | 1.45 | 1.34 | 1.27 | 0.5 | 3.8 | 5.7 | C | C | C | A | B | B |
| 6 | 1.45 | 1.33 | 1.20 | 0.5 | 4.0 | 6.2 | C | C | C | B | C | C |

The layer thickness of the charge transport layer of the photosensitive member thus tested was measured. As a result, it was 22 μm, showing a wear of 3 μm of the photosensitive layer.

Comparative Example 7

Tests were made in the same manner as in Comparative Example 6 except that a residual toner cleaning unit having a blade as a cleaning member was provided in the modified machine used in Example 6. Fog and image density at the initial stage and the 8,000th sheet running were examined. As a result, the image density and fog were 1.44 and 0.5%, respectively, at the initial stage; and 1.38 and 3.9%, respectively, at the 8,000th sheet running.

The layer thickness of the charge transport layer of the photosensitive member thus tested was measured. As a result, it was 16 μm, showing a wear of 9 μm, resulting in a lowering of the lifetime of the photosensitive layer.

TABLE 5(A)

| | Photo-sensi-tive member | Exposure intensity applied | Toner | Isolated dot reproducibility at initial stage | Gradation reproducibility at initial stage |
|---|---|---|---|---|---|
| Example: | | | | | |
| 6 | No. 4 | 0.50 cJ/m$^2$ | Toner No. 1 | Excellent | Excellent |
| 7 | No. 4 | 0.50 cJ/m$^2$ | Toner No. 6 | Excellent | Excellent |
| 8 | No. 1 | 0.55 cJ/m$^2$ | Toner No. 2 | Excellent | Excellent |
| 9 | No. 1 | 0.55 cJ/m$^2$ | Toner No. 3 | Excellent | Excellent |
| 10 | No. 2 | 1.70 cJ/m$^2$ | Toner No. 3 | Excellent | Excellent |
| Comparative Example: | | | | | |
| 5 | No. 3 | 2.90 cJ/m$^2$ | Toner No. 4 | Excellent | Excellent |
| 5 | No. 3 | 4.50 cJ/m$^2$ | Toner No. 4 | Poor | Poor |
| 6 | No. 3 | 2.90 cJ/m$^2$ | Toner No. 5 | Excellent | Excellent |
| 6 | No. 3 | 2.40 cJ/m$^2$ | Toner No. 5 | Excellent | Average |

TABLE 5(B)

| | Evaluation on ghost images | | | | | | | | | | | |
|---|---|---|---|---|---|---|---|---|---|---|---|---|
| | Initial stage | | | | 6,000th sheet | | | | 8,000th sheet | | | |
| | 75 g/m² paper | 130 g/m² paper | 200 g/m² paper | OHP film | 75 g/m² paper | 130 g/m² paper | 200 g/m² paper | OHP film | 75 g/m² paper | 130 g/m² paper | 200 g/m² paper | OHP film |
| Example: | | | | | | | | | | | | |
| 6 | 0.00 | 0.00 | 0.00 | 0.00 | 0.00 | 0.00 | 0.00 | 0.00 | 0.00 | 0.00 | 0.00 | 0.00 |
| 7 | 0.00 | 0.00 | 0.00 | 0.00 | 0.00 | 0.00 | 0.00 | 0.00 | 0.00 | 0.00 | 0.00 | 0.00 |
| 8 | 0.00 | 0.00 | 0.00 | 0.00 | 0.00 | 0.00 | 0.00 | 0.00 | 0.00 | 0.00 | 0.00 | 0.00 |
| 9 | 0.00 | 0.00 | 0.00 | 0.00 | 0.00 | 0.00 | 0.00 | 0.00 | 0.00 | 0.00 | 0.00 | 0.00 |
| 10 | 0.00 | 0.00 | 0.00 | 0.00 | 0.00 | 0.00 | −0.01 | −0.01 | 0.00 | 0.00 | −0.02 | −0.01 |
| Comparative Example: | | | | | | | | | | | | |
| 5 | 0.00 | −0.01 | −0.05 | −0.04 | 0.00 | −0.02 | −0.05 | −0.05 | 0.00 | −0.02 | −0.05 | −0.04 |
| 5 | 0.00 | 0.00 | −0.01 | −0.01 | 0.00 | 0.00 | −0.01 | −0.02 | 0.00 | −0.01 | −0.02 | −0.02 |
| 6 | 0.00 | −0.02 | −0.04 | −0.02 | 0.00 | −0.02 | −0.04 | −0.03 | 0.00 | −0.02 | −0.04 | −0.03 |
| 6 | −0.01 | −0.03 | −0.06 | −0.06 | −0.01 | −0.04 | −0.07 | −0.06 | −0.01 | −0.05 | −0.06 | −0.07 |

TABLE 6

| | Exposure intensity applied | Gradation reproducibility | Density for each patten 1 | 2 | 3 | 4 | 5 | 6 | 7 | 8 |
|---|---|---|---|---|---|---|---|---|---|---|
| Example: | | | | | | | | | | |
| 6 | 0.50 cJ/m² | Excellent | 0.14 | 0.17 | 0.25 | 0.29 | 0.57 | 0.69 | 0.86 | 1.46 |
| 7 | 0.50 cJ/m² | Excellent | 0.14 | 0.17 | 0.26 | 0.34 | 0.60 | 0.74 | 0.87 | 1.46 |
| 8 | 0.55 cJ/m² | Excellent | 0.14 | 0.20 | 0.27 | 0.34 | 0.60 | 0.77 | 0.82 | 1.42 |
| 9 | 0.55 cJ/m² | Excellent | 0.14 | 0.19 | 0.26 | 0.37 | 0.68 | 0.79 | 0.90 | 1.43 |
| 10 | 1.70 cJ/m² | Excellent | 0.13 | 0.17 | 0.25 | 0.33 | 0.55 | 0.74 | 0.81 | 1.44 |
| Comparative Example: | | | | | | | | | | |
| 5 | 2.90 cJ/m² | Excellent | 0.12 | 0.15 | 0.22 | 0.26 | 0.55 | 0.65 | 0.81 | 1.45 |
| 5 | 4.50 cJ/m² | Poor | 0.18 | 0.19 | 0.34 | 0.41 | 0.71 | 0.88 | 1.21 | 1.47 |
| 6 | 2.90 cJ/m² | Excellent | 0.14 | 0.17 | 0.27 | 0.33 | 0.60 | 0.74 | 0.87 | 1.45 |
| 6 | 2.40 cJ/m² | Average | 0.13 | 0.16 | 0.23 | 0.31 | 0.54 | 0.73 | 0.78 | 1.41 |

What is claimed is:

1. An image forming method comprising repeating the steps of:

(a) electrostatically charging a photosensitive member;

(b) exposing the charged photosensitive member to form an electrostatic latent image;

(c) contacting a toner carried on a developer carrying member with the surface of the photosensitive member to develop the electrostatic latent image to form a toner image on the photosensitive member;

(d) transferring the toner image formed on the photosensitive member to a transfer medium; and (e) recovering residual toner remaining on the photosensitive member after the transfer step (d) to the developer carrying member simultaneous with the contacting step (c), wherein no additional step of removing residual toner is conducted between the transferring step (d) and the charging step (a);

wherein the surface of said photosensitive member has a contact angle with water of 85° or greater;

said toner contains residual monomer in an amount not more than 1,000 ppm; and said toner has a shape factor SF-1 from 100 to 180 and a shape factor SF-2 from 100 to 140.

2. The image forming method according to claim 1, wherein said electrostatic latent image is developed by reverse development, and said toner image is formed on the photosensitive member.

3. The image forming method according to claim 1, wherein the surface of said photosensitive member has a contact angle with water of 90° or greater, and said toner contains residual monomers in an amount of from 5 ppm to 500 ppm.

4. The image forming method according to claim 3, wherein the residual monomers in said toner are in an amount of from 10 ppm to 300 ppm.

5. The image forming method according to claim 1, wherein said electrostatic latent image is developed by reverse development, said toner image is formed on the photosensitive member, the surface of said photosensitive member has a contact angle with water of 90° or greater, said toner contains residual monomers in an amount of from 5 ppm to 500 ppm, and said toner has a shape factor SF-1 of from 100 to 140 and a shape factor SF-2 of from 100 to 120.

6. The image forming method according to claim 5, wherein the shape factor SF-1 of said toner is from 100 to 130 and SF-2, from 100 to 115.

7. The image forming method according to claim 6, wherein the residual monomers in said toner are in an amount of from 10 ppm to 300 ppm.

8. The image forming method according to claim 1, wherein said photosensitive member is a function-separated organic photosensitive member.

9. The image forming method according to claim 8, wherein said photosensitive member has a contact angle with water of 90° or greater.

10. The image forming method according to claim 8, wherein said function-separated organic photosensitive member has a protective layer as its outermost layer.

11. The image forming method according to claim 10, wherein said protective layer of the photosensitive member has a contact angle with water of 90° or greater.

12. The image forming method according to claim 1, wherein a material having fluorine atoms is present in the surface of said photosensitive member, and a value of F/C as measured by X-ray photoelectron spectroscopy is from 0.03 to 1.00.

13. The image forming method according to claim 1, wherein a material having silicon atoms is present in the surface of said photosensitive member, and a value of Si/C as measured by X-ray photoelectron spectroscopy is from 0.03 to 1.00.

14. The image forming method according to claim 1, wherein said developer carrying member performs cleaning-at-development while being rotated at a peripheral speed corresponding to 110% or more of the peripheral speed of said photosensitive member.

15. The image forming method according to claim 2, wherein said photosensitive member has a dark potential Vd and a light potential Vl, and a direct bias Vdc is applied to the developer carrying member so as to satisfy the relationship:

$|Vd-Vdc|>|Vl-Vdc|$.

16. The image forming method according to claim 15, wherein the direct bias Vdc has a voltage between the dark potential Vd and the light potential Vl.

17. The image forming method according to claim 16, wherein an absolute value of $|Vd-Vdc|$ is greater than an absolute value of $|Vl-Vdc|$ by 10 V or more.

18. The image forming method according to claim 1 or 2, wherein said electrostatic latent image is formed by exposure at an exposure intensity in a range determined by a point where, in the photosensitive member exposure intensity-surface potential characteristic curve, a straight line having a slope of 1/20 with respect to the slope of a straight line connecting a point of dark potential Vd and a point of an average value of dark potential Vd and residual potential Vr, (Vd+Vr)/2, touches the exposure intensity-surface potential characteristic curve, and by a point of five times the half-reduction exposure intensity.

19. The image forming method according to claim 1 or 2, wherein said toner is a non-magnetic toner, and said electrostatic latent image is developed by non-magnetic one-component contact development.

20. The image forming method according to claim 1 or 2, wherein said toner is a non-magnetic toner, which is blended with a magnetic carrier, and said electrostatic latent image is developed by magnetic brush contact development.

21. The image forming method according to claim 1, wherein said toner contains a low-softening substance having a melting point of from 40° C. to 90° C.

22. The image forming method according to claim 21, wherein said low-softening substance is contained in said toner in an amount of from 5% by weight to 30% by weight.

23. The image forming method according to claim 1, wherein said toner is a capsule toner having a core/shell structure.

24. The image forming method according to claim 1, wherein said toner contains toner particles formed by subjecting a monomer composition to suspension polymerization in an aqueous medium.

* * * * *

UNITED STATES PATENT AND TRADEMARK OFFICE

CERTIFICATE OF CORRECTION

PATENT NO. : 5,753,396

DATED : May 19, 1998

INVENTOR(S) : TATSUYA NAKAMURA, ET AL.

It is certified that error appears in the above-identified patent and that said Letters Patent is hereby corrected as shown below:

On the title page, item

[57] ABSTRACT

Line 16, "a wherein;" should read --wherein;--

COLUMN 3

Line 24, "comprising;" should read --comprising:--.

COLUMN 4

Line 34, "use" should read --use of--.

COLUMN 5

Line 27, "damages" should read --damage--;
Line 42, "affected," should read --affected--; and
Line 48, "affected" should read --affect--.

COLUMN 12

Line 13, "enables" should read --enable--;
Line 27, "agent" should read --agents--; and
Line 28, "a amount" should read --an amount--.

COLUMN 14

Line 6, "and there added" should read
--and to which there is added--.

COLUMN 19

Line 1, "compounds;" should read --compounds,--.

UNITED STATES PATENT AND TRADEMARK OFFICE

CERTIFICATE OF CORRECTION

PATENT NO. : 5,753,396

DATED : May 19, 1998

INVENTOR(S) : TATSUYA NAKAMURA, ET AL.

It is certified that error appears in the above-identified patent and that said Letters Patent is hereby corrected as shown below:

COLUMN 21

Line 30, "form an" should read --form a--.

COLUMN 27

Line 42, "Produciton" should read --Production--.

COLUMN 31

Line 56, "(wherein m represents an integer)," should be deleted; and
Line 58, "50 parts" should read --(wherein m represents an integer), 50 parts--;

COLUMN 32

Line 25, "(wherein m represents an integer)," should be deleted; and
Line 64, "was" should read --were--.

COLUMN 35

Line 25, "next page:" should read --below:--.

COLUMN 40

Line 49, "copolymer." should read --copolymer--.

UNITED STATES PATENT AND TRADEMARK OFFICE

CERTIFICATE OF CORRECTION

PATENT NO. : 5,753,396

DATED : May 19, 1998

INVENTOR(S) : TATSUYA NAKAMURA, ET AL.

It is certified that error appears in the above-identified patent and that said Letters Patent is hereby corrected as shown below:

COLUMN 43

Line 46, "low-molecular." should read --low-molecular--.

Signed and Sealed this

Nineteenth Day of January, 1999

*Attest:*

*Attesting Officer*

*Acting Commissioner of Patents and Trademarks*